US012384637B2

(12) United States Patent
Okazaki et al.

(10) Patent No.: US 12,384,637 B2
(45) Date of Patent: Aug. 12, 2025

(54) SHEET CONVEYANCE APPARATUS, SHEET SUPPORT APPARATUS, AND IMAGE FORMING APPARATUS

(71) Applicant: CANON KABUSHIKI KAISHA, Tokyo (JP)

(72) Inventors: Shunsuke Okazaki, Shizuoka (JP); Yasuaki Matsumoto, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 127 days.

(21) Appl. No.: 18/198,920

(22) Filed: May 18, 2023

(65) Prior Publication Data

US 2023/0391566 A1 Dec. 7, 2023

(30) Foreign Application Priority Data

Jun. 3, 2022 (JP) ..... 2022-091005

(51) Int. Cl.
*B65H 1/08* (2006.01)

(52) U.S. Cl.
CPC ..... *B65H 1/08* (2013.01); *B65H 2402/412* (2013.01); *B65H 2402/441* (2013.01); *B65H 2402/45* (2013.01); *B65H 2404/67* (2013.01); *B65H 2801/06* (2013.01)

(58) Field of Classification Search
CPC ..... B65H 2404/67; B65H 2511/12; B65H 2405/324; B65H 2402/45; B65H 2402/412
See application file for complete search history.

(56) References Cited

U.S. PATENT DOCUMENTS

| | | | | |
|---|---|---|---|---|
| 11,530,104 | B2 | 12/2022 | Okazaki | |
| 2019/0119056 | A1* | 4/2019 | Imai | B65H 1/04 |
| 2019/0146406 | A1* | 5/2019 | Kawaguchi | G03G 21/1633 399/107 |
| 2021/0155432 | A1* | 5/2021 | Okazaki | B65H 1/04 |

FOREIGN PATENT DOCUMENTS

| | | | |
|---|---|---|---|
| JP | H08-95330 | A | 4/1996 |
| JP | 2004-029271 | A | 1/2004 |
| JP | 2014-170058 | A | 9/2014 |

* cited by examiner

*Primary Examiner* — Jennifer Bahls
(74) *Attorney, Agent, or Firm* — VENABLE LLP

(57) ABSTRACT

A sheet conveyance apparatus includes an apparatus body including a conveyance assembly to convey a sheet, and a door pivotally supported around a pivot axis disposed in a lower portion of the apparatus body such that the door is opened and closed with respect to the apparatus body. The apparatus body includes a handle assembly including a first holder used to lift the apparatus body and is disposed inside a width of the door in an axis direction of the pivot axis. The handle assembly includes a first engaging section and a second engaging section disposed on the pivot axis, wherein the door includes a first engaged section to engage with the first engaging section and a second engaged section to engage with the second engaging section. The door is pivotably supported around the first engaging section and the second engaging section with respect to the handle assembly.

13 Claims, 17 Drawing Sheets

SHEET CONVEYANCE APPARATUS, SHEET SUPPORT APPARATUS, AND IMAGE FORMING APPARATUS

BACKGROUND OF THE INVENTION

Field of the Invention

The present invention relates to a sheet conveyance apparatus that conveys a sheet, a sheet support apparatus that supports a sheet and an image forming apparatus.

Description of the Related Art

Japanese Patent Application Publication No. 2014-170058 proposes a copying machine that includes a housing and a double-sided cover. The double-sided cover is supported by the housing so as to be able to be opened and closed with respect to the housing by a user pivoting the double-sided cover on a cover pivot shaft. The copying machine is provided with a right-front handle portion and a right-back handle portion, which are used as handles when the copying machine is carried. The right-front handle portion and the right-back handle portion are disposed below the double-sided cover, and fixed to the housing.

However, since the right-front handle portion and the right-back handle portion are disposed below the double-sided cover, the cover pivot shaft of the double-sided cover described in Japanese Patent Application Publication No. 2014-170058 is positioned above the right-front handle portion and the right-back handle portion. Thus, the opening portion formed when the double-sided cover is opened becomes smaller, which causes insufficient maintainability.

In addition, the right-front handle portion and the right-back handle portion described in Japanese Patent Application Publication No. 2014-170058 are separate members, and disposed separated from each other. Thus, in the right side surface of the copying machine, more boundary lines between components are formed, which causes poor external appearance.

SUMMARY OF THE INVENTION

According to a first aspect of the present invention, a sheet conveyance apparatus includes an apparatus body including a conveyance portion configured to convey a sheet, and a door portion pivotally supported around a pivot axis disposed in a lower portion of the apparatus body such that the door portion is opened and closed with respect to the apparatus body. The apparatus body includes a holding member including a first holding portion used to lift the apparatus body, and the holding member is disposed inside a width of the door portion in an axis direction of the pivot axis. The holding member includes a first engaging portion and a second engaging portion disposed on the pivot axis. The door portion includes a first engaged portion configured to engage with the first engaging portion, and a second engaged portion configured to engage with the second engaging portion. The door portion is pivotably supported around the first engaging portion and the second engaging portion with respect to the holding member.

According to a second aspect of the present invention, a sheet support apparatus includes a sheet support portion configured to support a sheet, a regulation portion supported by the sheet support portion such that the regulation portion is configured to move in a first direction and a second direction opposite to the first direction, the regulation portion being configured to regulate a position of a downstream edge, in the first direction, of the sheet supported by the sheet support portion, and a brake unit configured to produce a first frictional force between the sheet support portion and the regulation portion in a case where the regulation portion moves toward the second direction, and produce a second frictional force larger than the first frictional force between the sheet support portion and the regulation portion in a case where the regulation portion moves toward the first direction.

Further features of the present invention will become apparent from the following description of exemplary embodiments with reference to the attached drawings.

DESCRIPTION OF THE EMBODIMENTS

Overall Configuration

Figure 1:
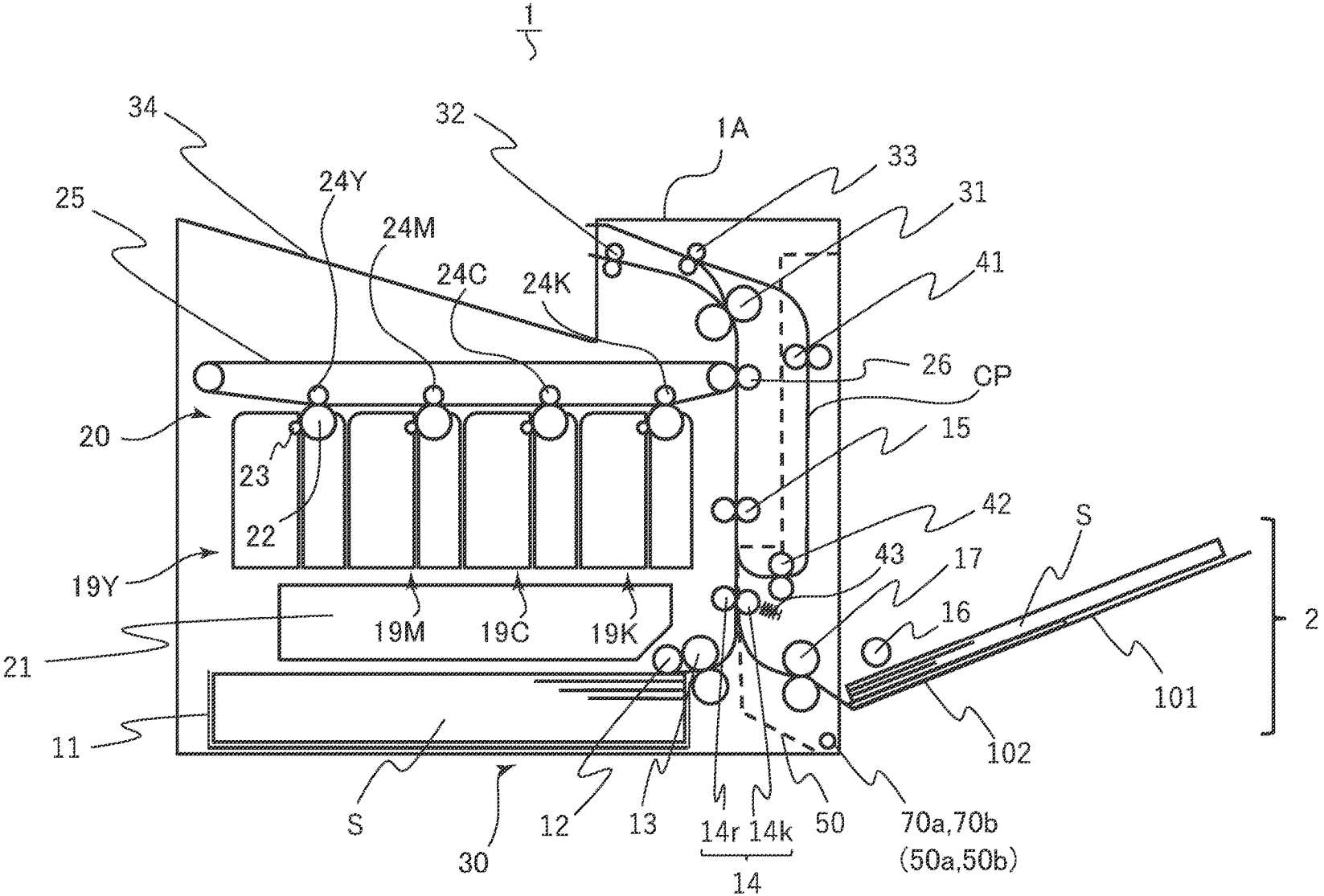
FIG. 1 is an overall schematic diagram illustrating a printer of an embodiment.

An image forming apparatus 1 of the present embodiment is an electrophotographic full-color laser-beam printer. As illustrated in FIG. 1, the image forming apparatus 1 includes an image forming portion 20 that forms an image on a sheet S, a sheet feeding portion 30, a fixing apparatus 31, and a manual-feed conveyance portion 2. The image forming portion 20 includes four process cartridges 19Y, 19M, 19C, and 19K, and a scanner unit 21. The four process cartridges 19Y, 19M, 19C, and 19K are used for forming four-color toner images of yellow (Y), magenta (M), cyan (C), and black (K), respectively.

Note that the four process cartridges 19Y, 19M, 19C, and 19K are the same in configuration as each other, except that they produce different colors of images. For this reason, the configuration and the image forming process of only the process cartridge 19Y will be described, and the description for the process cartridges 19M, 19C, and 19K will be omitted.

The process cartridge 19Y includes a photosensitive drum 22, a charging roller (not illustrated), and a developing roller 23. The photosensitive drum 22 has an organic photoconductive layer coated on the outer surface of an aluminum cylinder, and is rotated by a driving motor (not illustrated). In addition, the image forming portion 20 includes an intermediate transfer belt 25, and primary transfer rollers 24Y, 24M. 24C, and 24K disposed inside the intermediate transfer belt 25.

The fixing apparatus 31 includes a fixing film that is heated by a heater (not illustrated), and a pressing roller that is in pressure contact with the fixing film. The sheet feeding portion 30 is disposed in a lower portion of the image forming apparatus 1; and includes a cassette 11 that stores sheets, a pickup roller 12 that feeds a sheet, and a separation roller pair 13.

Next, an image forming operation of the image forming apparatus 1 configured in this manner will be described. When the scanner unit 21 receives an image signal from an apparatus, such as a personal computer (not illustrated), the scanner unit 21 emits a laser beam, produced in accordance with the image signal, to the photosensitive drum 22 of the process cartridge 19Y.

Since the surface of the photosensitive drum 22 is uniformly charged in advance by the charging roller (not illustrated) so as to have a predetermined polarity and potential, an electrostatic latent image is formed on the surface of the photosensitive drum 22 when the surface of the photosensitive drum 22 is irradiated with the laser beam from the scanner unit 21. The electrostatic latent image formed on the photosensitive drum 22 is developed by the developing roller 23, and a yellow (Y) toner image is formed on the photosensitive drum 22.

Similarly, photosensitive drums of the process cartridges 19M, 19C, and 19K are also irradiated with laser beams from the scanner unit 21; and magenta (M), cyan (C), and black (K) toner images are formed on the photosensitive drums. The toner images formed on the photosensitive drums and having respective colors are transferred onto the intermediate transfer belt 25 by the primary transfer rollers 24Y, 24M, 24C, and 24K; and are conveyed to the secondary transfer roller 26 by the intermediate transfer belt 25 that rotates. Note that an image forming process for one color is performed at a timing at which a corresponding toner image is superposed on an upstream toner image which has been primary-transferred onto the intermediate transfer belt 25.

In parallel with the image forming process, a sheet S is fed from the sheet feeding portion 30 or the manual-feed conveyance portion 2. For example, a sheet S stored in the cassette 11 of the sheet feeding portion 30 is fed by the pickup roller 12. The sheet S fed by the pickup roller 12 is separated from others, one by one, by the separation roller pair 13; and is conveyed to a registration roller pair 15.

The manual-feed conveyance portion 2 includes a manual feed cover 101, a manual feed tray 102, a pickup roller 16, and a separation roller pair 17. The manual feed cover 101 is supported by the conveyance cover 50 so as to be able to be opened and closed, and the manual feed tray 102 is held by the manual feed cover 101. The sheet S stacked on the manual feed tray 102 is fed by the pickup roller 16; then separated from others, one by one, by the separation roller pair 17; and then conveyed to the registration roller pair 15.

The registration roller pair 15 corrects the skew of the sheet S, and conveys the sheet S at a predetermined conveyance timing. Then, a full-color toner image on the intermediate transfer belt 25 is transferred onto the sheet S by a secondary transfer bias applied to the secondary transfer roller 26.

The sheet S onto which the toner image has been transferred is then applied with predetermined heat and pressure by the fixing film and the pressing roller of the fixing apparatus 31, so that the toner is melted and solidifies (fixed). Then, the sheet S having passed through the fixing apparatus 31 is discharged to a discharging tray 34 by a discharge roller pair 32.

In a case where images are to be formed on both sides of the sheet S, after an image is fixed to a first side of the sheet S by the fixing apparatus 31, the sheet S is conveyed toward a reversing roller pair 33. Then the sheet S is switch-backed by the reversing roller pair 33, and is conveyed and guided to a duplex conveyance path CP. The sheet S having been guided to the duplex conveyance path CP is conveyed again to the secondary transfer roller 26 by conveyance roller pairs 41 and 42 and the registration roller pair 15. Then an image is formed on a second side of the sheet S by the secondary transfer roller 26, and the image is fixed to the second side of the sheet S by the fixing apparatus 31. After that, the sheet S is discharged to the discharging tray 34.

The image forming apparatus 1 includes an apparatus body 1A and the conveyance cover 50. The apparatus body 1A includes the image forming portion 20 and the sheet feeding portion 30. The conveyance cover 50 serves as a door portion, and is supported so as to be able to be opened and closed with respect to the apparatus body 1A. As described in detail below, the conveyance cover 50, which is indicated by a dotted-line area of FIG. 1, is disposed on the right side surface of the image forming apparatus 1; and the conveyance cover 50 supports a driven roller 14*k* of the conveyance roller pair 14, a driven roller of the conveyance roller pair 41, a driven roller of the conveyance roller pair 42, and the manual-feed conveyance portion 2. The conveyance roller pair 14 includes a driving roller 14*r* that serves as a first roller driven by a driving motor (not illustrated), and the driven roller 14*k* that serves as a second roller rotated by the rotation of the driving roller 14*r*. The driven roller 14*k* is urged by a spring 43, which serves as an urging member, so that the driven roller 14*k* is in pressure contact with the driving roller 14*r*. Note that the driven roller 14*k* may serve as a driving roller and the driving roller 14*r* may serve as a driven roller. In another case, another elastic member, such as a rubber member or a sponge member, may be used in place of the spring 43.

Peripheral Configuration of Conveyance Cover

Figure 2A:
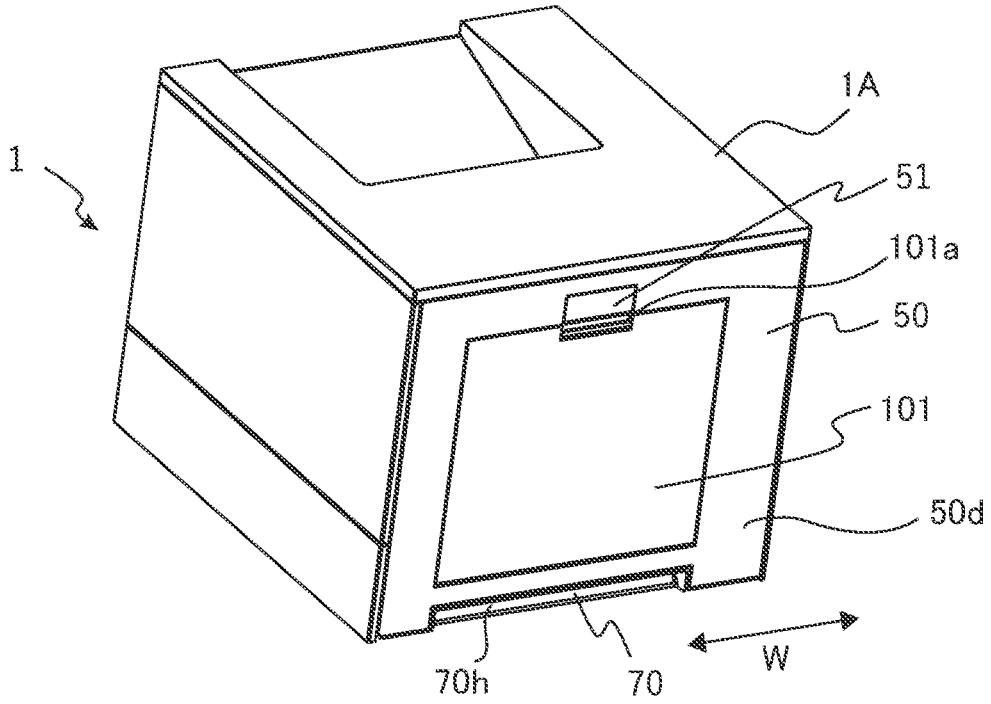
FIG. 2A is a perspective view illustrating an image forming apparatus that is in a state where a conveyance cover is closed.

Next, a peripheral configuration of the conveyance cover 50 will be described with reference to FIGS. 2A to 3. As illustrated in FIG. 2A, the conveyance cover 50 is disposed on the right side surface of the image forming apparatus 1, and the manual feed cover 101 is supported by the conveyance cover 50 so as to be able to be opened and closed. The conveyance cover 50 can be opened by a user operating a handle 51. The manual feed cover 101 includes a recess portion 101*a*, which is disposed below the handle 51; and can be opened and closed with respect to the conveyance cover 50, by a user operating the recess portion 101*a*.

Figure 2B:
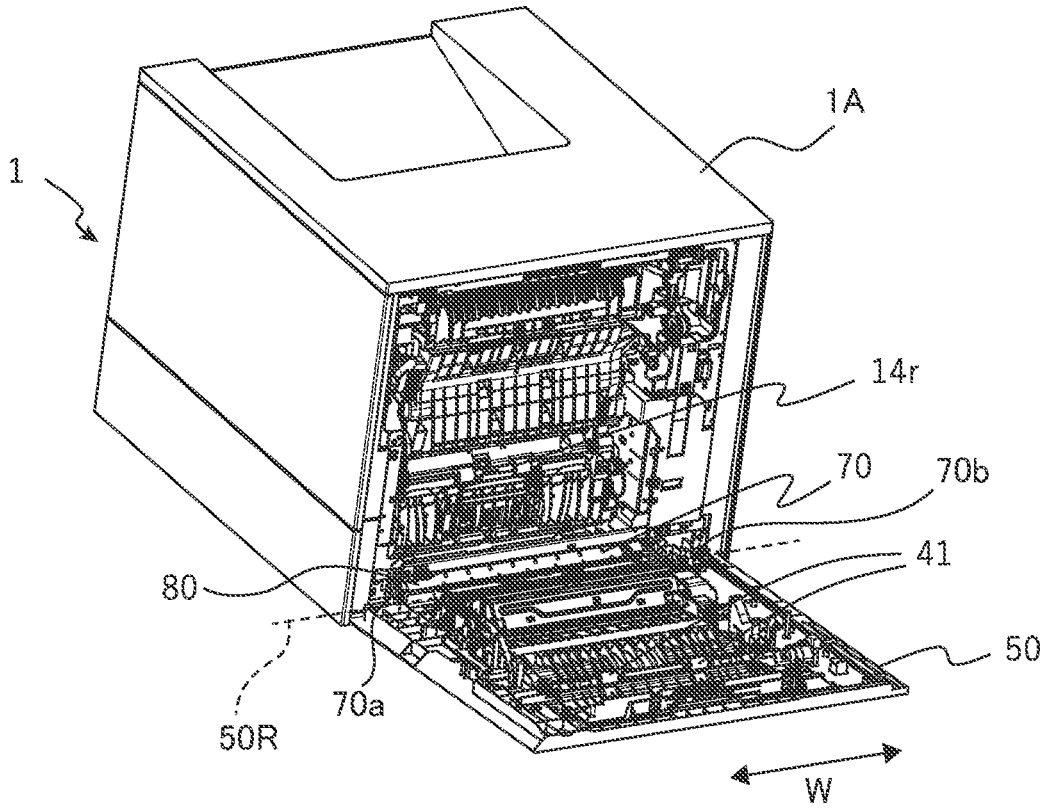
FIG. 2B is a perspective view illustrating the image forming apparatus that is in a state where the conveyance cover is opened.

As illustrated in FIGS. 2A and 2B, the apparatus body 1A includes a frame 80 and a handle 70. The handle 70 serves as a holding member fixed to the frame 80. Since the handle 70 is fixed to the frame 80 as illustrated in FIG. 2B, the position and posture of the handle 70 do not change even when the conveyance cover 50 is opened and closed. As illustrated in FIG. 2A, the handle 70 includes a holding portion 70*h*, which serves as a first holding portion used to lift the apparatus body 1A by a user. The holding portion 70*h* is recessed with respect to an exterior surface 50*d* of the conveyance cover 50 in a state where the conveyance cover 50 is closed with respect to the apparatus body 1A.

In addition, the handle 70 is disposed in a lower portion of the apparatus body 1A and inside the width of the conveyance cover 50 in a width direction W. In other words, the front edge of the handle 70 is positioned behind the front edge of the conveyance cover 50, and the back edge of the handle 70 is positioned in front of the back edge of the conveyance cover 50.

Figure 3:
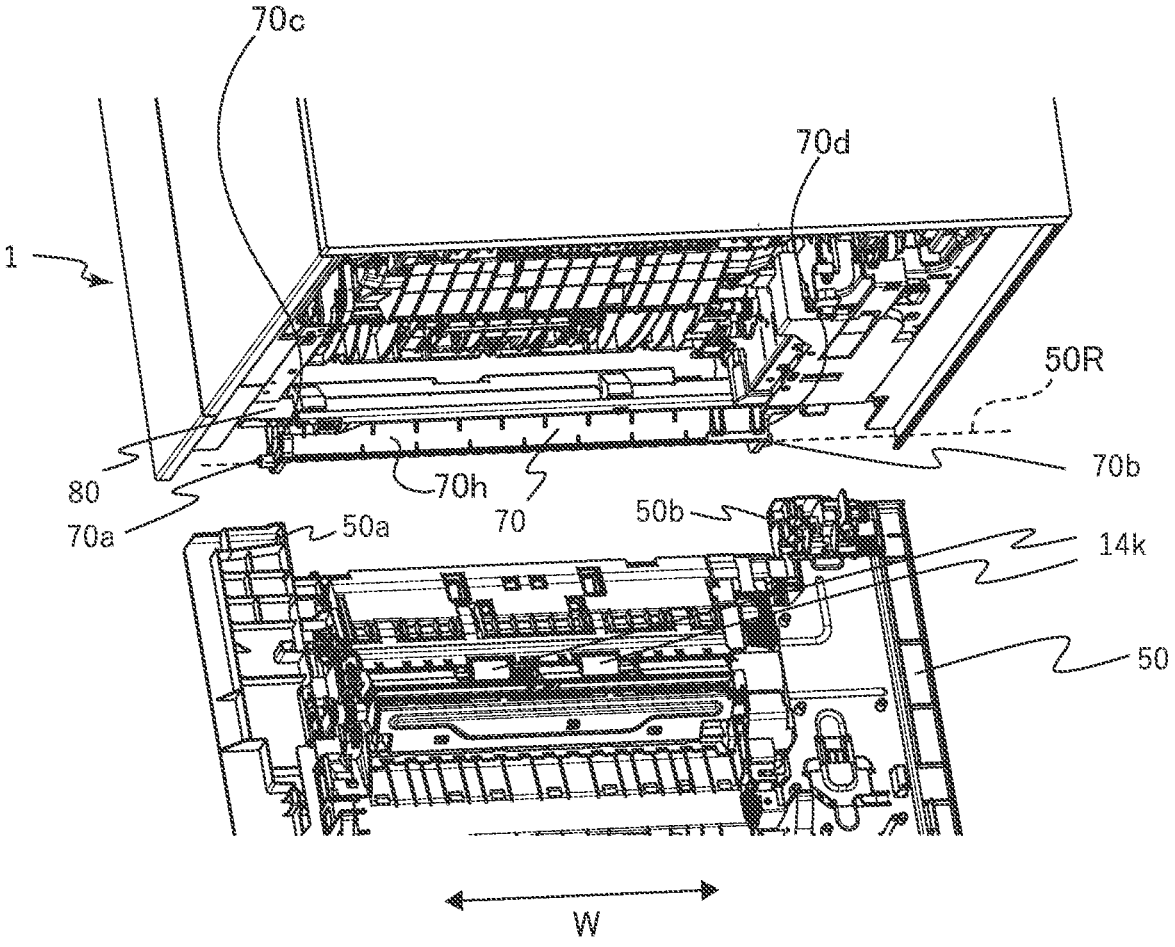
FIG. 3 is an exploded perspective view illustrating the image forming apparatus that is in a state where the conveyance cover is detached.

As illustrated in FIG. 3, the handle 70 includes a first shaft portion 70*a* and a second shaft portion 70*b*. The first shaft portion 70*a* serves as a first engaging portion that is disposed on a lower edge portion of a first end surface 70*c*. The first end surface 70*c* is the surface of one end portion of the handle 70 in the width direction W. The second shaft portion 70*b* serves as a second engaging portion that is disposed on a lower edge portion of a second end surface 70*d*. The second end surface 70*d* is the surface of the other end portion of the handle 70 in the width direction W. That is, the holding portion 70*h* is disposed between the first shaft portion 70*a* and the second shaft portion 70*b* in the width direction W. The first shaft portion 70*a* and the second shaft portion 70*b* are shaft portions that extend in directions, one of which extends away from the other in the width direction W.

In addition, the conveyance cover 50 includes a first hole portion 50*a* and a second hole portion 50*b*. The first hole portion 50*a* serves as a first engaged portion that engages with the first shaft portion 70*a*. The second hole portion 50*b* serves as a second engaged portion that engages with the second shaft portion 70*b*. The conveyance cover 50 is pivotably supported around the first shaft portion 70*a* and the second shaft portion 70*b* with respect to the handle 70. In other words, the first shaft portion 70*a*, the second shaft portion 70*b*, the first hole portion 50*a*, and the second hole portion 50*b* are disposed on a pivot axis 50R that is a center of pivot of the conveyance cover 50. The axis direction of the pivot axis 50R is parallel with the width direction W. That is, the conveyance cover 50 is pivotably supported by the apparatus body 1A around the pivot axis 50R disposed in a lower portion of the apparatus body 1A.

Figure 4A:
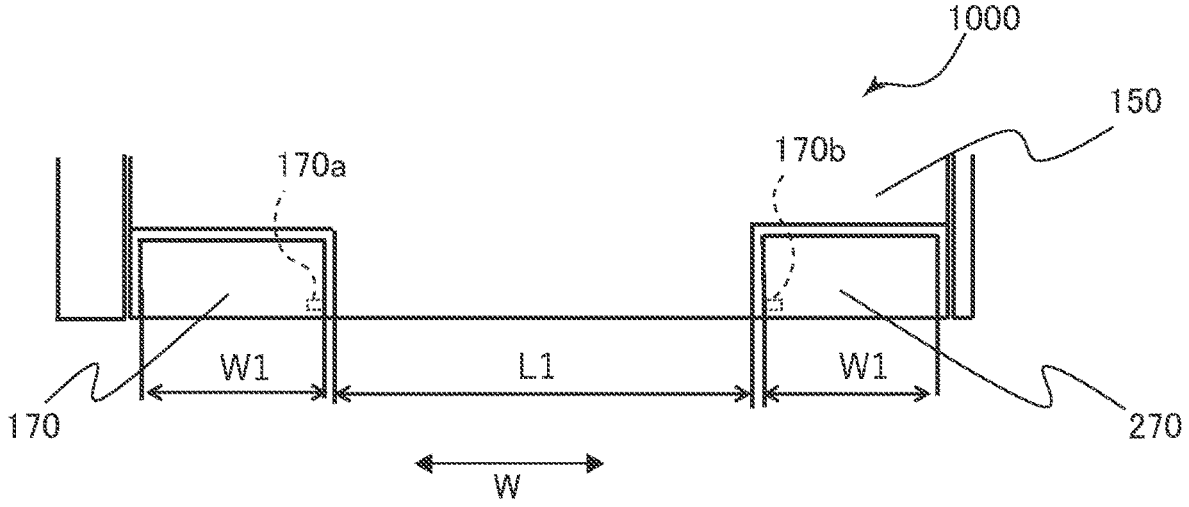
FIG. 4A is a diagram illustrating a shaft-to-shaft distance of a comparative example.

Next, an image forming apparatus 1000 will be described as a comparative example with reference to FIG. 4A. As illustrated in FIG. 4A, the image forming apparatus 1000 has two handles 170 and 270. The handle 170 is disposed in a front edge portion of the image forming apparatus 1000, and the handle 270 is disposed in a back edge portion of the image forming apparatus 1000. A conveyance cover 150 of the image forming apparatus 1000 is pivotally supported by a first shaft portion 170*a* disposed on the handle 170, and by a second shaft portion 170*b* disposed on the handle 270.

Each of the handles 170 and 270 has a width W1, which is necessary for a user to hold the handle for carrying the image forming apparatus 1000. Thus, a shaft-to-shaft distance L1 between the first shaft portion 170*a* and the second shaft portion 170*b* in the width direction W is shortened by double the width W1 of each of the two handles 170 and 270.

If the shaft-to-shaft distance L1 is shortened, the misalignment of the conveyance cover 150 produced in the attachment of the conveyance cover 150 will have more affect on the inclination of the conveyance cover 150 with respect to the pivot center axis. In addition, when the conveyance cover 150 is closed, the position of the conveyance cover 150 may deviate from a nominal position. Since the conveyance cover 150 supports the driven rollers of the conveyance roller pairs 14, 41, and 42, the stability of conveyance of sheets will deteriorate if the position of the conveyance cover 150 deviates from the nominal position.

Figure 4B:
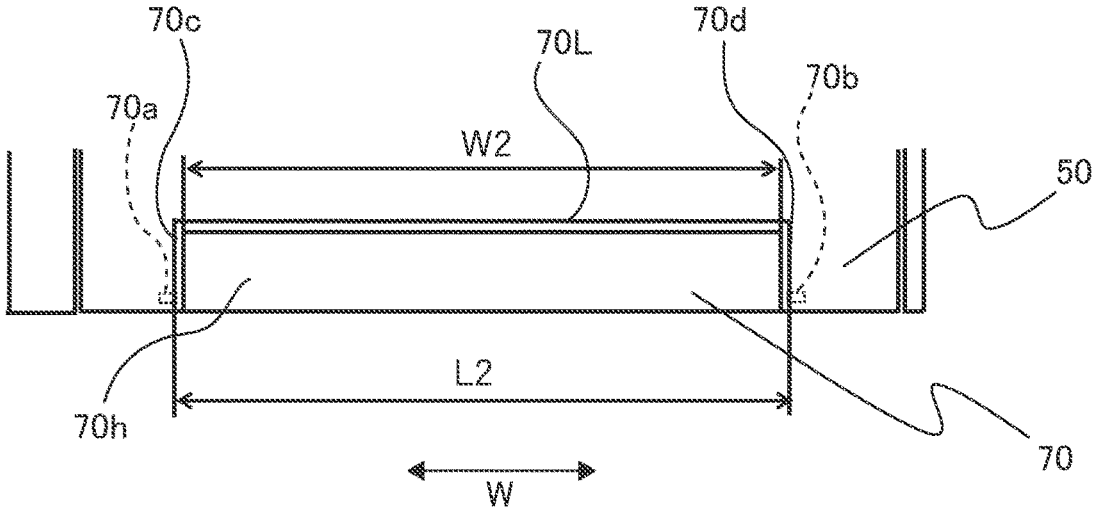
FIG. 4B is a diagram illustrating a shaft-to-shaft distance of the present embodiment.
Figure 5:
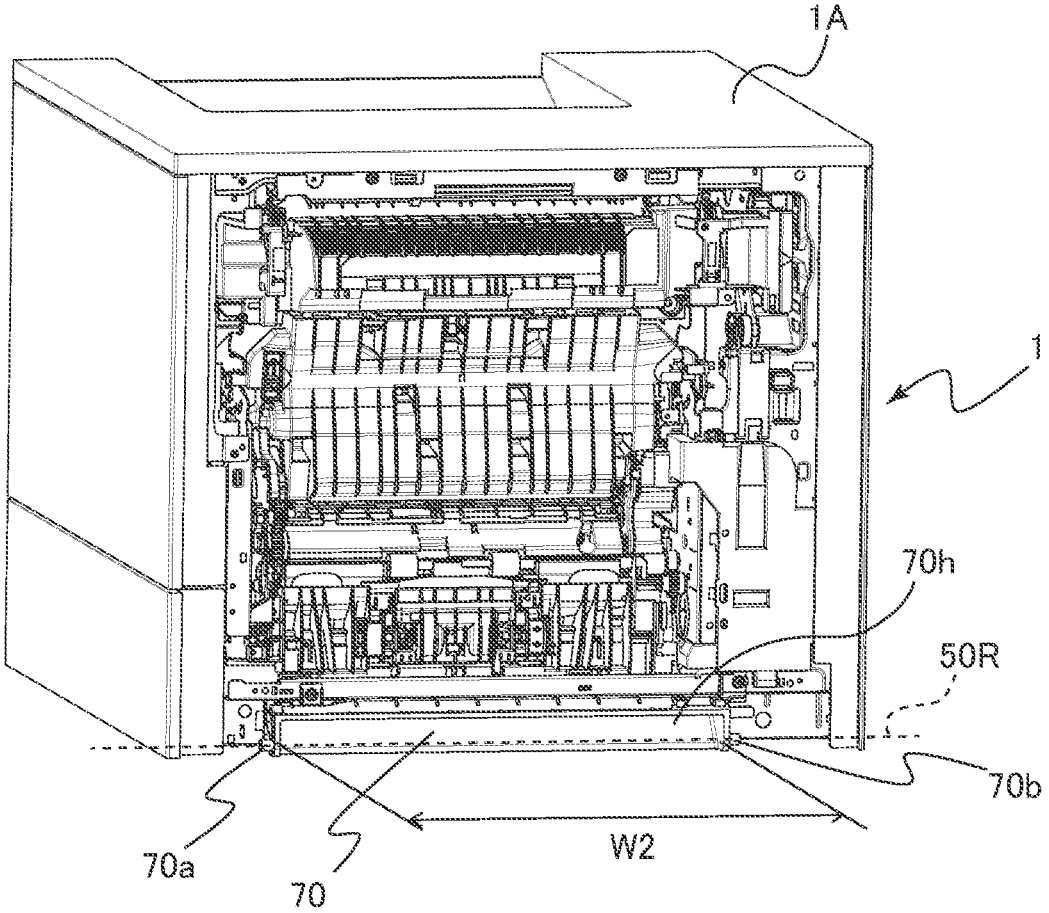
FIG. 5 is a perspective view illustrating an apparatus body that is in a state where the conveyance cover is detached.

In contrast, in the present embodiment, only one handle 70 is disposed in the substantially central portion of the conveyance cover 50 in the width direction W, as illustrated in FIGS. 4B and 5. FIG. 5 is a perspective view illustrating the apparatus body 1A that is in a state where the conveyance cover 50 is detached from the apparatus body 1A. As can be seen, the holding portion 70*h* of the handle 70 has a width W2 that is sufficient for a user to hold the holding portion 70*h* for carrying the apparatus body 1A of the image forming apparatus 1.

As described above, the first shaft portion 70*a* and the second shaft portion 70*b*, which pivotally support the conveyance cover 50, are respectively disposed on the first end surface 70*c* and the second end surface 70*d* of the handle 70. Thus, even in a state where the handle 70 has the width W2, it is possible to secure a shaft-to-shaft distance L2 between the first shaft portion 70*a* and the second shaft portion 70*b* in the width direction W. The shaft-to-shaft distance L2 is larger than the shaft-to-shaft distance L1.

Figure 6:
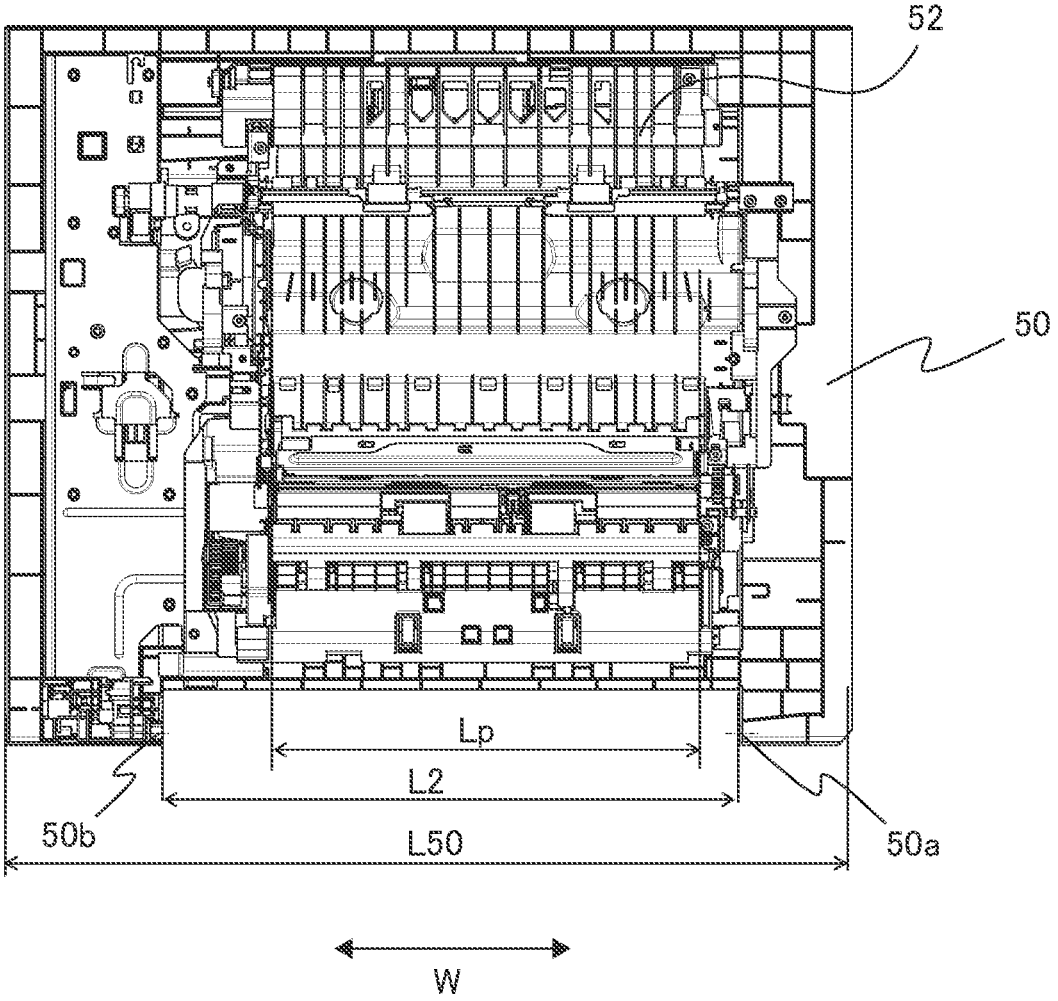
FIG. 6 is a diagram of the conveyance cover viewed from the apparatus body side.

FIG. 6 is a front view of the conveyance cover 50 closed with respect to the apparatus body 1 and viewed from the apparatus body 1A side. As illustrated in FIG. 6, the conveyance cover 50 has a width L50 in the width direction W. In addition, the conveyance cover 50 has a conveyance guide 52, which constitutes a part of the duplex conveyance path CP (see FIG. 1). The duplex conveyance path CP is a conveyance path through which the sheet S, conveyed by the reversing roller pair 33 that serves as a conveyance portion, passes. The conveyance guide 52 has a width Lp, which is the length of the conveyance guide 52 in the width direction W. Note that the conveyance guide 52 may be formed integrated with the conveyance cover 50, or may be a separate member different from the conveyance cover 50.

The above-described shaft-to-shaft distance L2 of the present embodiment is set equal to or larger than two thirds of the width L50 of the conveyance cover 50. In addition, the shaft-to-shaft distance L2 is larger than the width Lp of the conveyance guide 52. Since the shaft-to-shaft distance L2 is set longer as much as possible, the misalignment of the conveyance cover 50 produced in the attachment of the conveyance cover 50 have less affect on the inclination of the conveyance cover 50 with respect to the pivot axis 50R. As a result, it becomes possible to improve the operational feeling that a user feels when opening and closing the conveyance cover 50. In addition, it becomes possible to suppress the deviation of the position of the conveyance cover 50 from a nominal position, and improve the stability of conveyance of sheets.

In addition, in the present embodiment, the first shaft portion 70*a* is disposed on a lower edge portion of the first end surface 70*c* of the handle 70, and the second shaft portion 70*b* is disposed on a lower edge portion of the second end surface 70*d*. With this arrangement, it is possible to dispose the pivot axis 50R of the conveyance cover 50 in a lower edge portion of the handle 70 and in a lower edge portion of the image forming apparatus 1. Thus, the opening formed when the conveyance cover 50 is opened can be made larger. As a result, it becomes possible to improve the maintainability, which is necessary for a user to perform the jam handling, the replacement of a process cartridge, the maintenance of the interior of the apparatus body 1A, and the like.

Furthermore, in the present embodiment, since the handle 70 is not divided into two members and is a single member, boundary lines between components can be made simple in the right side surface of the image forming apparatus 1. More specifically, as illustrated in FIG. 4B, since a boundary line 70L between the handle 70 and the conveyance cover 50 is a single continuous line, the external appearance of the image forming apparatus 1 can be improved. In addition, since the number of components is made smaller than that in the configuration in which two handles are disposed, the cost can be reduced.

Lock Mechanism

Figure 7:
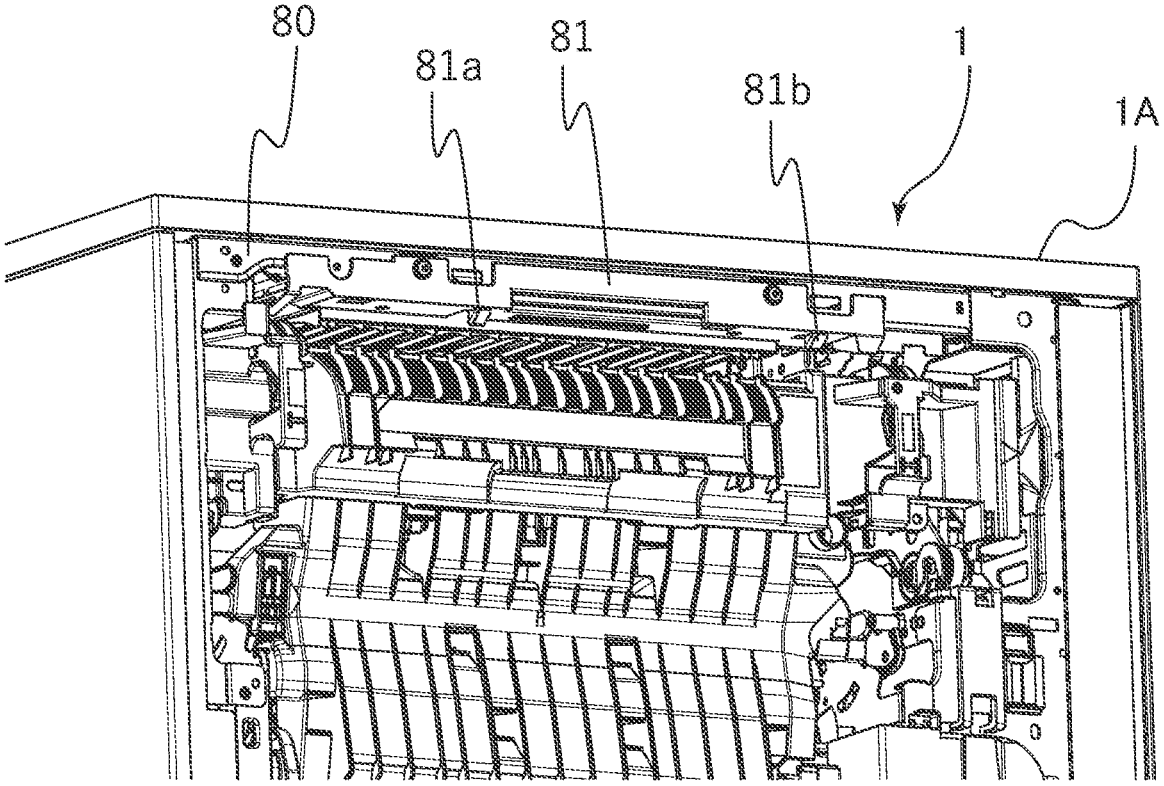
FIG. 7 is a perspective view illustrating a conveyance guide of the apparatus body.

Next, a lock mechanism will be described. The lock mechanism causes the apparatus body 1A to hold the conveyance cover 50 in a state where the conveyance cover 50 is closed. As illustrated in FIG. 7, a conveyance guide 81 is fixed to the frame 80 of the apparatus body 1A. The conveyance guide 81 constitutes a part of the duplex conveyance path CP (see FIG. 1), and guides the sheet S. The conveyance guide 81 serves as a locked member, and includes hook portions 81*a* and 81*b*.

Figure 8:
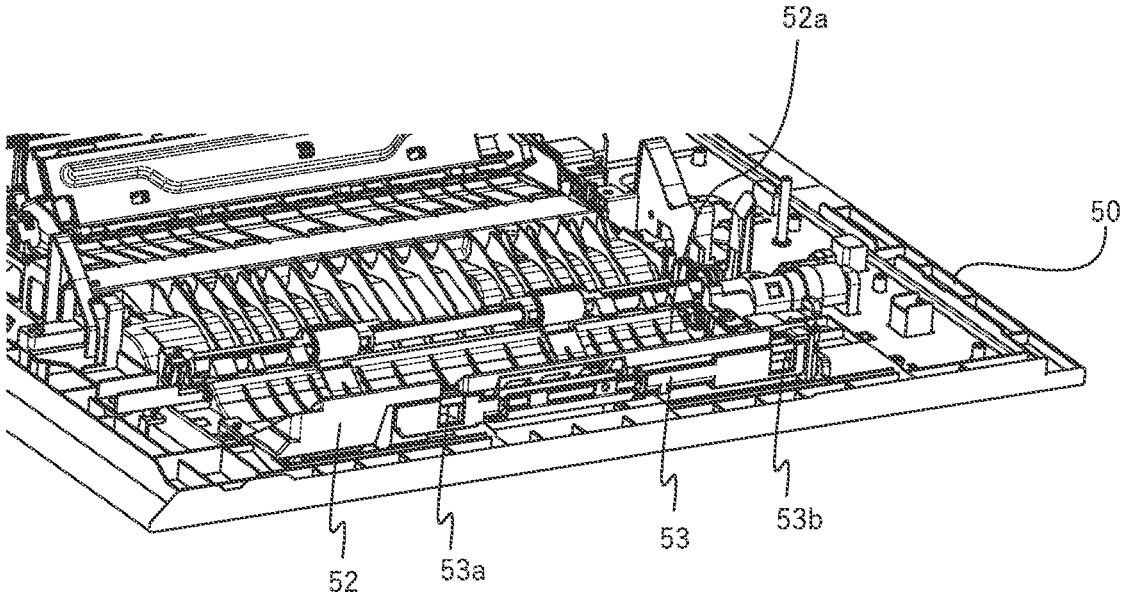
FIG. 8 is a perspective view illustrating a locking member disposed on the conveyance cover.

In addition, as illustrated in FIG. 8, the conveyance guide 52 is fixed to the conveyance cover 50. The conveyance guide 52 constitutes a part of the duplex conveyance path CP (see FIG. 1), and supports a locking member 53 such that the locking member 53 can move. The conveyance guide 52 includes a guide surface 52*a* that guides the sheet S. The locking member 53 includes locking hole portions 53*a* and 53*b* that can respectively engage with the hook portions 81*a* and 81*b* disposed in the conveyance guide 81 of the apparatus body 1A.

More specifically, the locking member 53 can move between a locking position (see FIG. 9A) and an unlocking position (see FIG. 9B), with respect to the conveyance guide 52. When the locking member 53 is located at the locking position, the locking hole portions 53*a* and 53*b* engage with the hook portions 81*a* and 81*b*, and the locking member 53 locks the conveyance cover 50 on the apparatus body 1A. When the locking member 53 is located at the unlocking position, the locking hole portions 53*a* and 53*b* are separated from the hook portions 81*a* and 81*b*, and the locking member 53 allows the conveyance cover 50 to be opened and closed with respect to the apparatus body 1A.

Figure 9A:
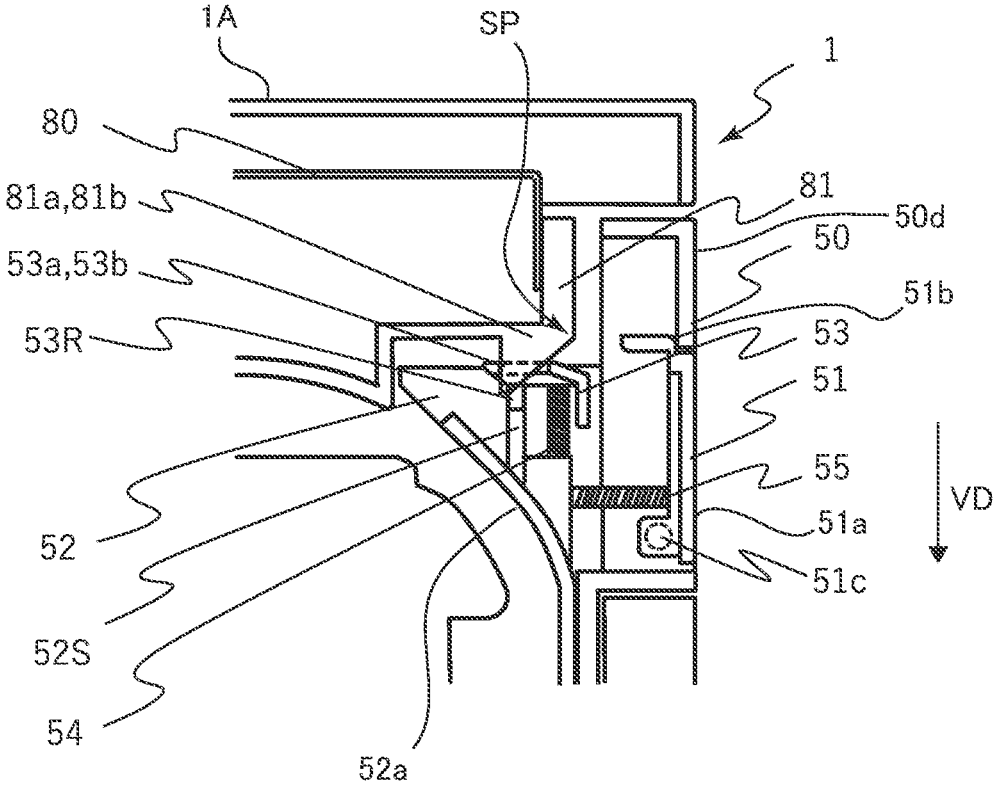
FIG. 9A is a cross-sectional view illustrating a state where a handle is located at a first position and the locking member is located at a locking position.

Next, with reference to FIG. 2 and FIGS. 9A and 9B, a more detailed configuration of the lock mechanism will be described. As illustrated in FIGS. 2A and 9A, the conveyance cover 50 supports the handle 51, which serves as a cover member, such that the handle 51 can pivot on an opening-and-closing axis 51*c* and can be opened and closed. More specifically, the handle 51 has an exterior surface 51*a* that constitutes a part of the exterior of the image forming apparatus 1. The handle 51 can move between a first position illustrated in FIG. 9A, and a second position illustrated in FIG. 9B. When the handle 51 is located at the first position, the exterior surface 51*a* is flush with the exterior surface 50*d* of the conveyance cover 50. If a user presses the exterior surface 51*a*, the handle 51 is pushed inward, and moved from the first position to the second position. At the first position, the handle 51 covers a below-described holding portion 50*h*.

The handle 51 is urged, clockwise in FIG. 9A, by a spring 55 toward the first position. An abutment surface 51*b* formed on the handle 51 abuts against the conveyance cover 50, so that the handle 51 is positioned at the first position.

The conveyance guide 52 of the conveyance cover 50 is provided with a slide guide 52S that extends in a vertical direction VD. The locking member 53 includes a slide rib 53R that can engage with the slide guide 52S. The locking member 53 is supported such that the engagement between the slide guide 52S and the slide rib 53R allows the locking member 53 to slide with respect to the conveyance guide 52 in the vertical direction VD. The locking member 53 is urged by a spring 54, which serves as an urging member, toward the above-described locking position, and is positioned at the locking position by a stopper (not illustrated).

Next, with reference to FIGS. 9A to 10B, the operation of the handle 51, the locking member 53, and the conveyance cover 50 will be described. As illustrated in FIG. 9A, in a state where the conveyance cover 50 is closed with respect to the apparatus body 1A, the handle 51 is positioned at the first position, and the locking member 53 is positioned at the locking position.

Figure 9B:
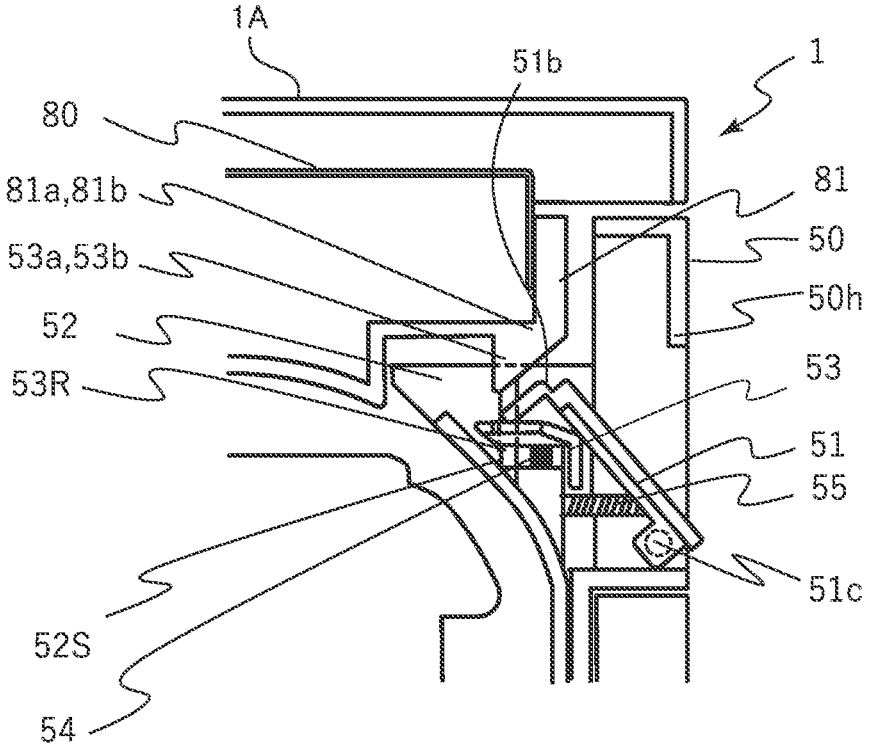
FIG. 9B is a cross-sectional view illustrating a state where the handle is located at a second position and the locking member is located at an unlocking position.

As illustrated in FIGS. 9A and 9B, when a user opens the conveyance cover 50 with respect to the apparatus body 1A, the user presses the exterior surface 51*a* of the handle 51 with a finger. With this operation, the handle 51 pivots counterclockwise on the opening-and-closing axis 51*c* against the urging force of the spring 55, and moves from the first position to the second position. After that, the user can access the holding portion 50*h* disposed above the handle 51 and inside the conveyance cover 50. Thus, the user can hook a finger to the holding portion 50*h*, which serves as a second holding portion, and hold the holding portion 50*h*.

While the handle 51 moves from the first position to the second position, the handle 51 presses the locking member 53 downward against the urging force of the spring 54. With this operation, the locking member 53 slides to the unlocking position, as illustrated in FIG. 9B. Since the locking member 53 is pushed downward from the locking position to the unlocking position, the hook portions, 81*a* and 81*b*, and the locking hole portions, 53*a* and 53*b*, are disengaged from each other, and the conveyance cover 50 is allowed to be opened and closed with respect to the apparatus body 1A.

As described with reference to FIG. 1, the conveyance cover 50 rotatably supports the driven roller 14*k*, and in a state where the conveyance cover 50 is closed, the driven roller 14*k* is urged by the spring 43 so as to be in pressure contact with the driving roller 14*r*. In addition, the driven roller 14*k* receives a reaction force, due to an urging force of the spring 43, from the driving roller 14*r* in a direction in which the conveyance cover 50 is opened.

As illustrated in FIG. 9B, when the locking member 53 moves to the unlocking position, the conveyance cover 50 is moved with respect to the apparatus body 1A and opened, by the above-described reaction force. With this operation, the conveyance cover 50 is moved to the open position and opened, as illustrated in FIG. 2B. Note that a user may move the conveyance cover 50 to the open position for opening the conveyance cover 50, while holding the holding portion 50*h*, after pressing and moving the handle 51 from the first position to the second position.

Figure 10A:
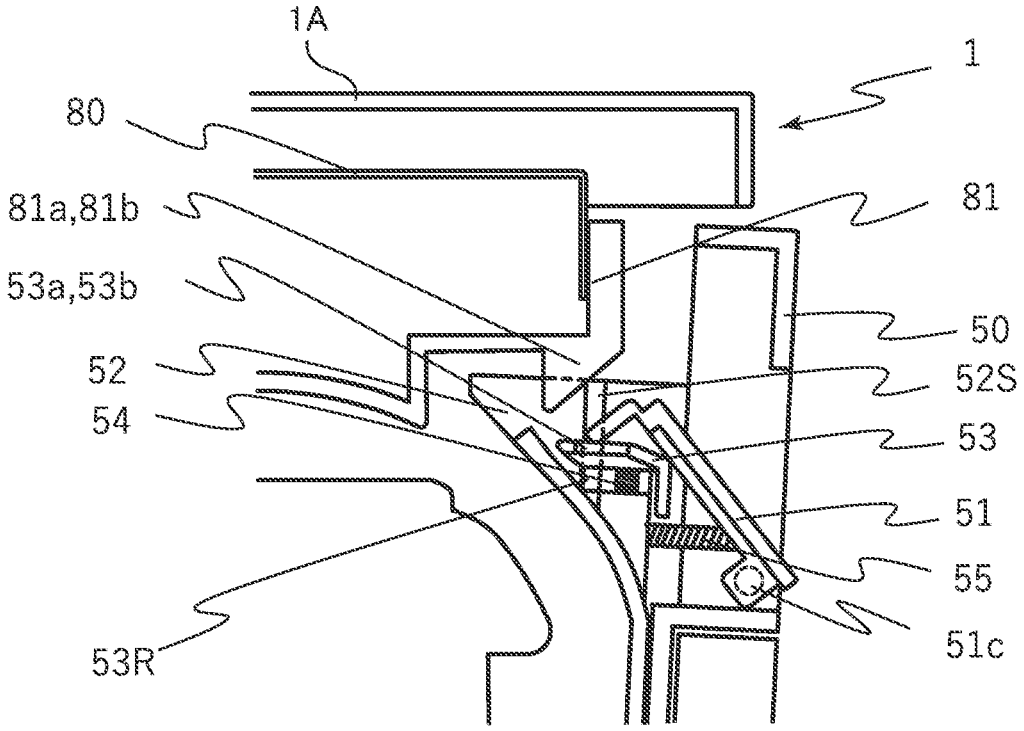
FIG. 10A is a cross-sectional view illustrating a state where the conveyance cover is being opened while receiving an urging force of a spring.
Figure 10B:
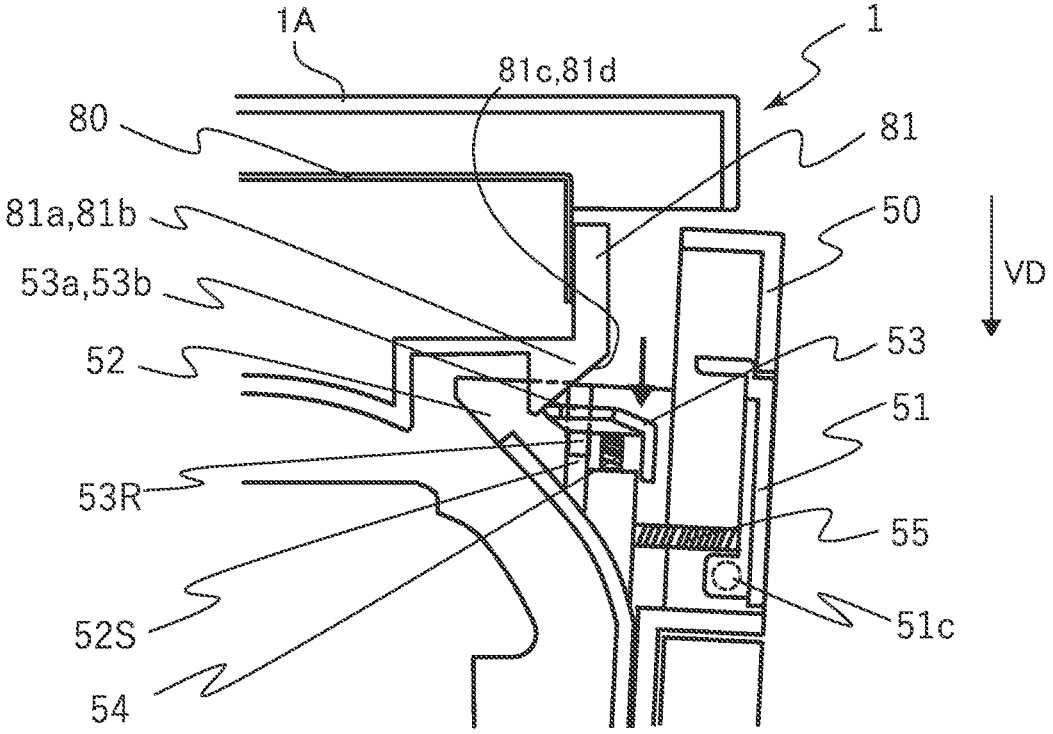
FIG. 10B is a cross-sectional view illustrating a state where the locking member is being pushed downward by a hook portion.

When a user closes the conveyance cover 50 with respect to the apparatus body 1A, the user holds one portion of the conveyance cover 50 and pivots the conveyance cover 50 toward the closing direction, on the pivot axis 50R (see FIG. 2B), as illustrated in FIG. 10B. As a result, the locking member 53 abuts against sloped surfaces 81*c* and 81*d* of the hook portions 81*a* and 81*b*. The sloped surfaces 81*c* and 81*d* are sloped such that as the sloped surfaces 81*c* and 81*d* extend closer to the photosensitive drum 22 (see FIG. 1) in the horizontal direction, the sloped surfaces 81*c* and 81*d* extend more downward in the vertical direction VD.

If the conveyance cover 50 is further closed in this state, the locking member 53 is pressed downward by the sloped surfaces 81*c* and 81*d* against the urging force of the spring 54. If the edge portion of the locking member 53 climbs over the sloped surfaces 81*c* and 81*d*, and the hook portions, 81*a* and 81*b*, and the locking hole portions, 53*a* and 53*b*, engage with each other, the locking member 53 is pushed upward to the locking position by the urging force of the spring 54. With this operation, the conveyance cover 50 is locked in a state where the conveyance cover 50 is closed with respect to the apparatus body 1A.

Since the lock mechanism is configured in this manner, the handle 51 is flush with the exterior surface 50*d* of the conveyance cover 50 when located at the first position and applied with no external force. Thus, the right side surface of the image forming apparatus 1 has no projecting and recess portions to open the conveyance cover 50, so that the external appearance can be improved.

In addition, as illustrated in FIG. 9A, the locking member 53 is disposed in a space SP formed between the guide surface 52*a* of the conveyance guide 52 and the exterior surface 50*d* of the conveyance cover 50 in the horizontal direction. Since the image forming apparatus 1 is required to be downsized, the space SP needs to be made smaller. For this reason, in the present embodiment, the locking member 53 is configured to slide and move in the vertical direction VD. Thus, the locking member 53 can be disposed in the small space SP, and the amount of engagement between the locking hole portions, 53*a* and 53*b*, and the hook portions, 81*a* and 81*b*, in the vertical direction VD can be maximized. That is, the downsizing of the lock mechanism and the image forming apparatus 1, and the reliable lock of the conveyance cover 50 to the apparatus body 1A can be both achieved.

Furthermore, in the present embodiment, when a user moves the handle 51 from the first position to the second position, the locking member 53 moves to the unlocking position in accordance with the movement of the handle 51, and the conveyance cover 50 is automatically opened by the urging force of the spring 43. Thus, the need for troublesome operation for opening the conveyance cover 50 can be eliminated, so that the usability can be improved. In addition, since a user can intuitively hold the holding portion 50*h* that appears simultaneously when the user pushes and opens the handle 51, the user can open the conveyance cover 50 while holding the holding portion 50*h*. As a result, the shock caused when a user opens the conveyance cover 50 can be reduced.

Manual-Feed Conveyance Portion

Figure 11:
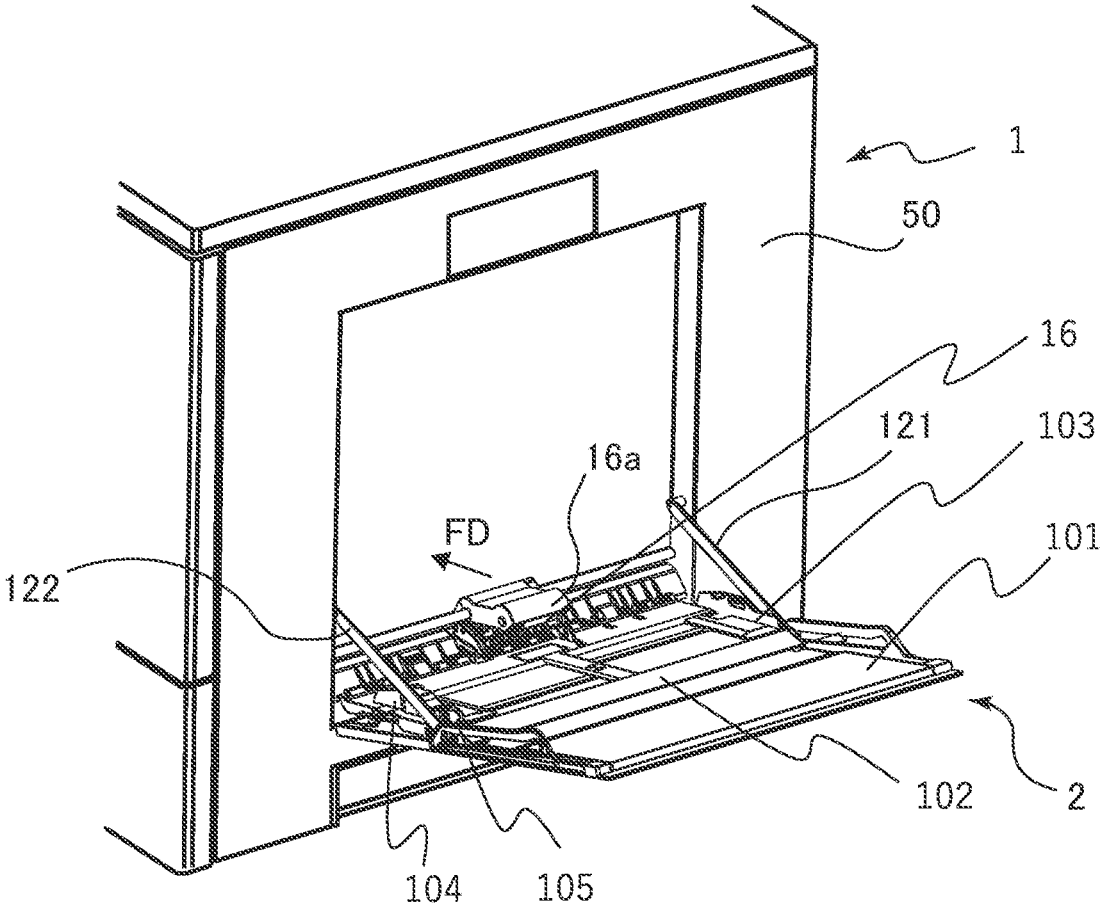
FIG. 11 is a perspective view illustrating a manual-feed conveyance portion.

Next, a lock configuration of side regulation plates 103 and 104 of the manual-feed conveyance portion 2 will be described. As illustrated in FIGS. 1 and 11, the manual-feed conveyance portion 2, which serves as a sheet support apparatus, includes a pickup arm 16*a* and a pickup roller 16. The pickup roller 16 is supported by the pickup arm 16*a* so as to be able to move up and down. In addition, the manual-feed conveyance portion 2 includes a manual feed cover 101, a manual feed tray 102, tray links 121 and 122, and the side regulation plates 103 and 104. The manual feed tray 102 serves as a sheet support portion. The pickup roller 16 feeds the sheet S stacked on the manual feed tray 102, in a feeding direction FD.

The manual feed cover 101 is supported so as to be opened and closed with respect to the conveyance cover 50, and constitutes a part of the exterior surface of the apparatus. On the top of the manual feed cover 101, the manual feed tray 102 is held. The manual feed cover 101 can be positioned at a predetermined degree of opening by the tray links 121 and 122. One end portion of each of the tray links 121 and 122 is linked to the manual feed tray 102, and the manual feed tray 102 can move in accordance with the opening/closing operation of the manual feed cover 101 along the manual feed cover 101. In this configuration, when the manual feed cover 101 is closed, the manual feed tray 102 is retracted from the pickup arm 16*a* and the pickup roller 16. Thus, the manual-feed conveyance portion 2 can be downsized.

Figure 12:
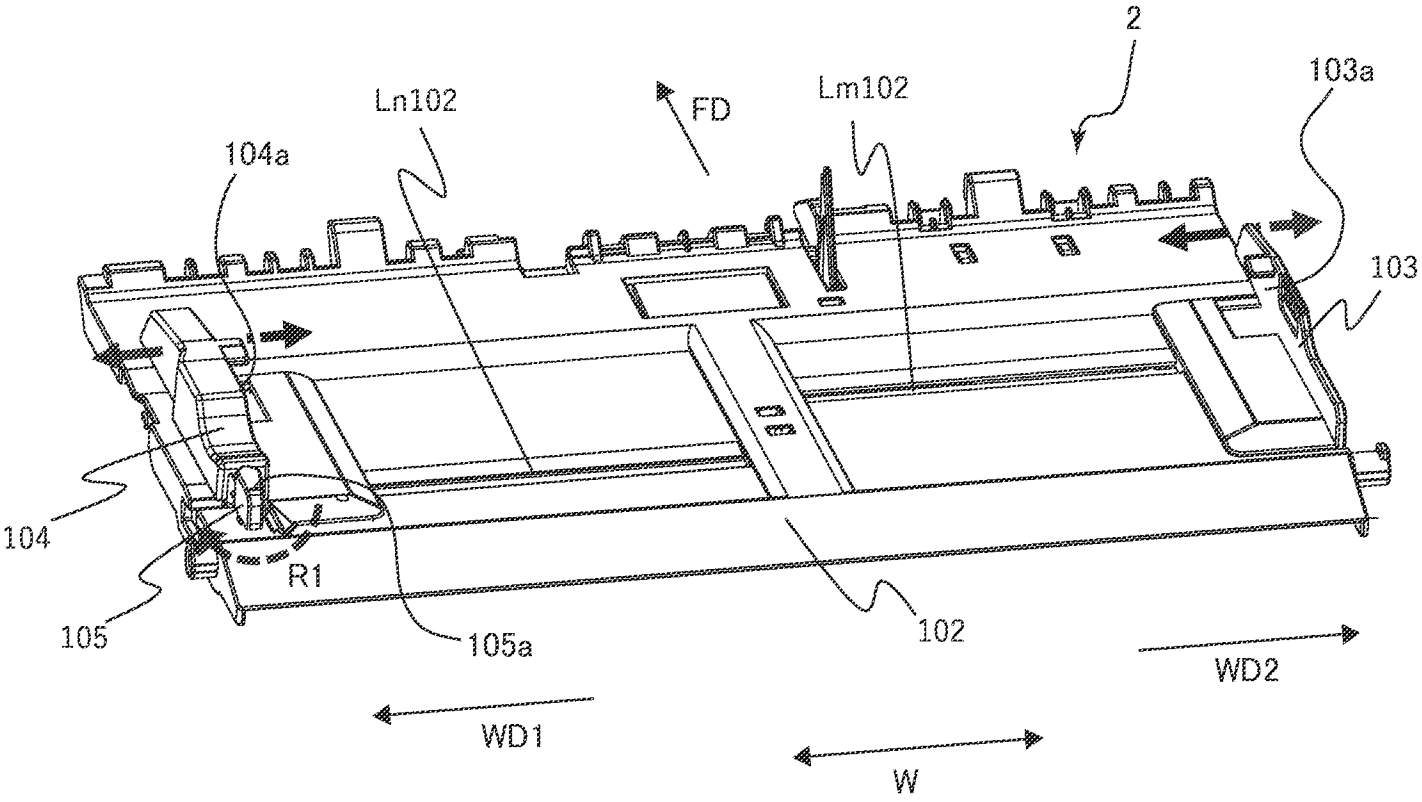
FIG. 12 is a perspective view illustrating side regulation plates.

As illustrated in FIG. 12, in the manual feed tray 102, guide grooves Lm102 and Ln102 that extend in the width direction W are formed. The side regulation plate 103 is held by the manual feed tray 102 so as to be able to move in the width direction W, along the guide groove Lm102. Similarly, the side regulation plate 104, which serves as a regulation portion, is held by the manual feed tray 102 so as to be able to move in the width direction W, along the guide groove Ln102.

Figure 13:
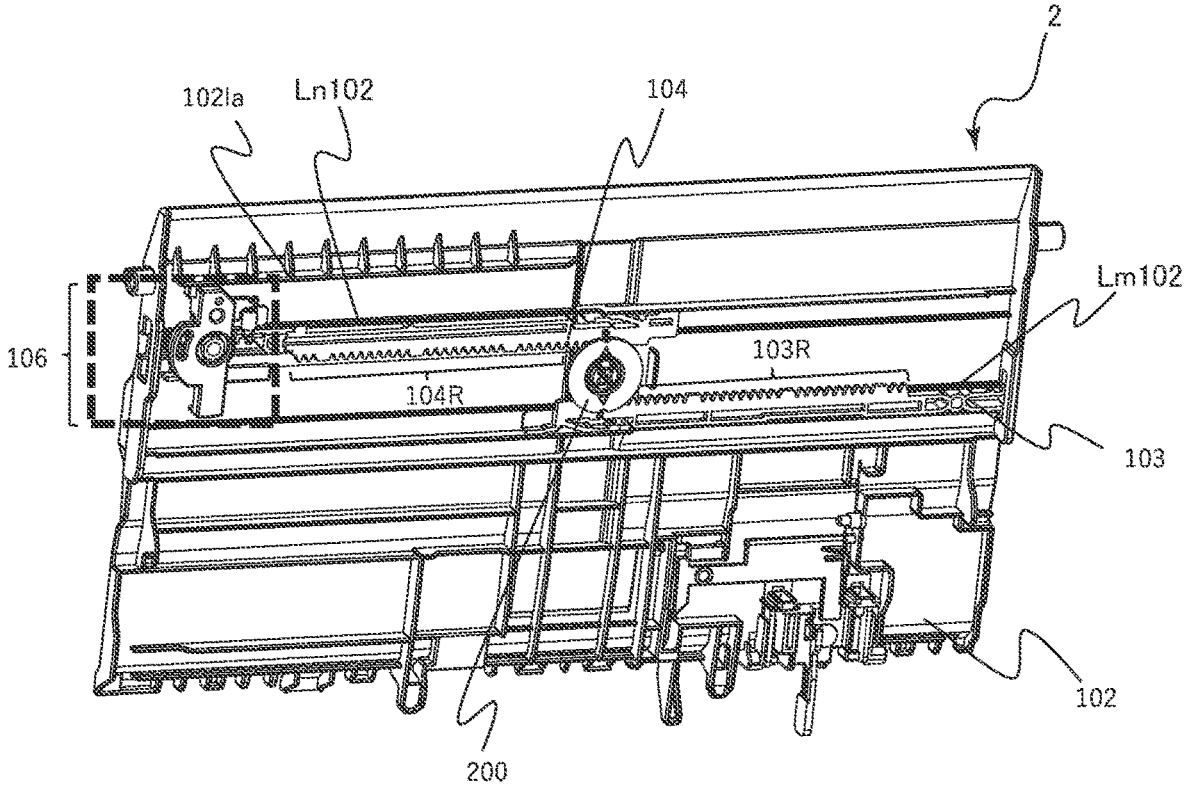
FIG. 13 is a bottom perspective view illustrating the side regulation plates and a brake mechanism.

As illustrated in FIG. 13, the side regulation plates 103 and 104 are respectively provided with rack-and-gear portions 103R and 104R, which extend in the width direction W. In addition, a pinion gear 200 that meshes with the rack-and-gear portions 103R and 104R is rotatably supported by the bottom portion of the manual feed tray 102. Thus, the side regulation plates 103 and 104 are linked with each other via the rack-and-gear portions 103R and 104R and the pinion gear 200, and move together so as to move in directions opposite to each other in the width direction W.

One direction in the width direction W is defined as a first direction WD1, and a direction opposite to the first direction WD1 is defined as a second direction WD2. That is, the first direction WD1 and the second direction WD2 are orthogonal to the feeding direction FD. For example, the side regulation plates 103 and 104 move together such that if the side regulation plate 103 is moved by a user toward the first direction WD1, the side regulation plate 104 moves toward the second direction WD2. The side regulation plate 103 includes a regulation surface 103*a* that regulates the position of a downstream edge of the sheet S stacked on the manual feed tray 102. The downstream edge is an edge of the sheet S, located downstream in the second direction WD2. The side regulation plate 104 includes a regulation surface 104*a* that regulates the position of a downstream edge of the sheet S stacked on the manual feed tray 102. The downstream edge is an edge of the sheet S, located downstream in the first direction WD1.

For example, by a user operating the side regulation plate 104, both edge portions of the sheet S (stacked on the manual feed tray 102), located in the width direction W, are nipped by the regulation surfaces 103*a* and 104*a*, so that the position of the sheet S in the width direction W is regulated. The manual-feed conveyance portion 2 is provided with a brake mechanism 106, which serves as a brake unit that generates frictional force (brake force) for preventing the movement of the side regulation plate 104.

Brake Mechanism

Figure 14:
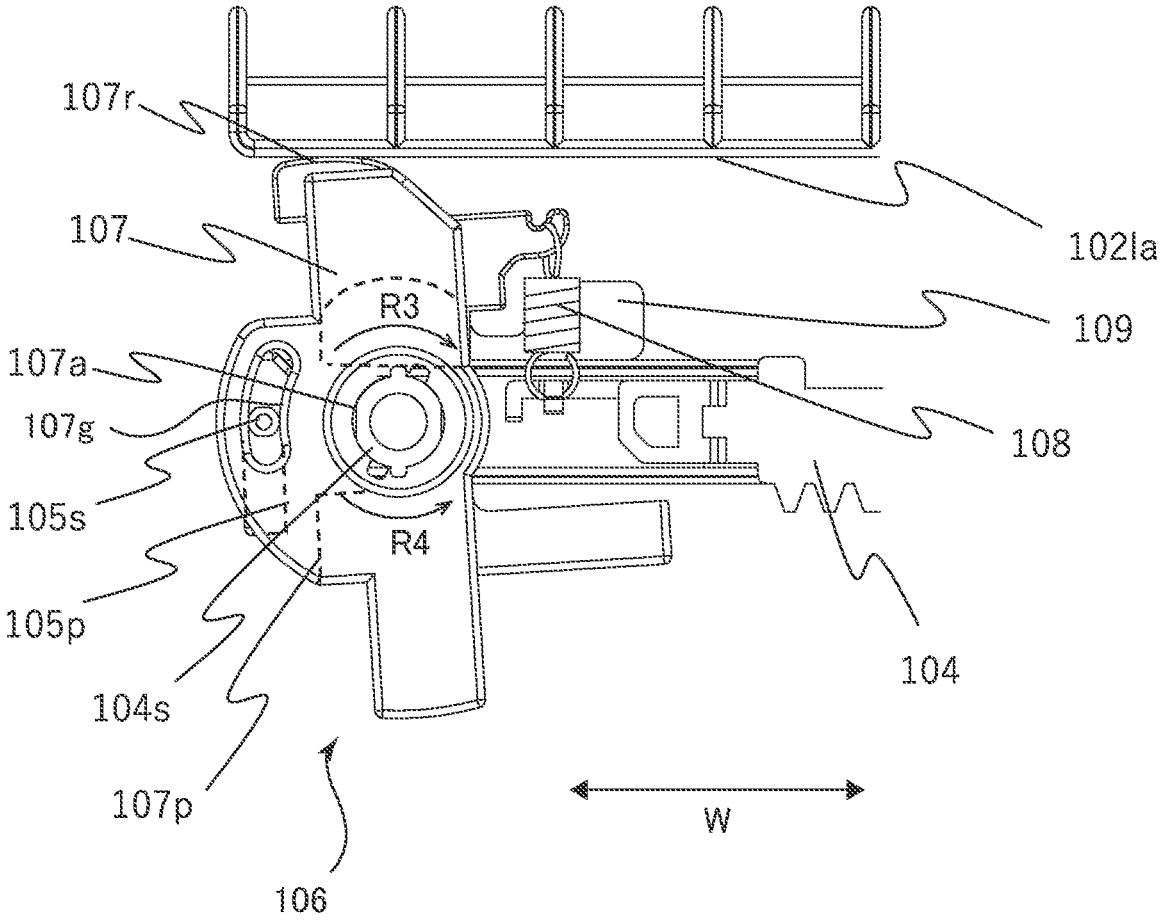
FIG. 14 is a front view illustrating the brake mechanism.
Figure 15:
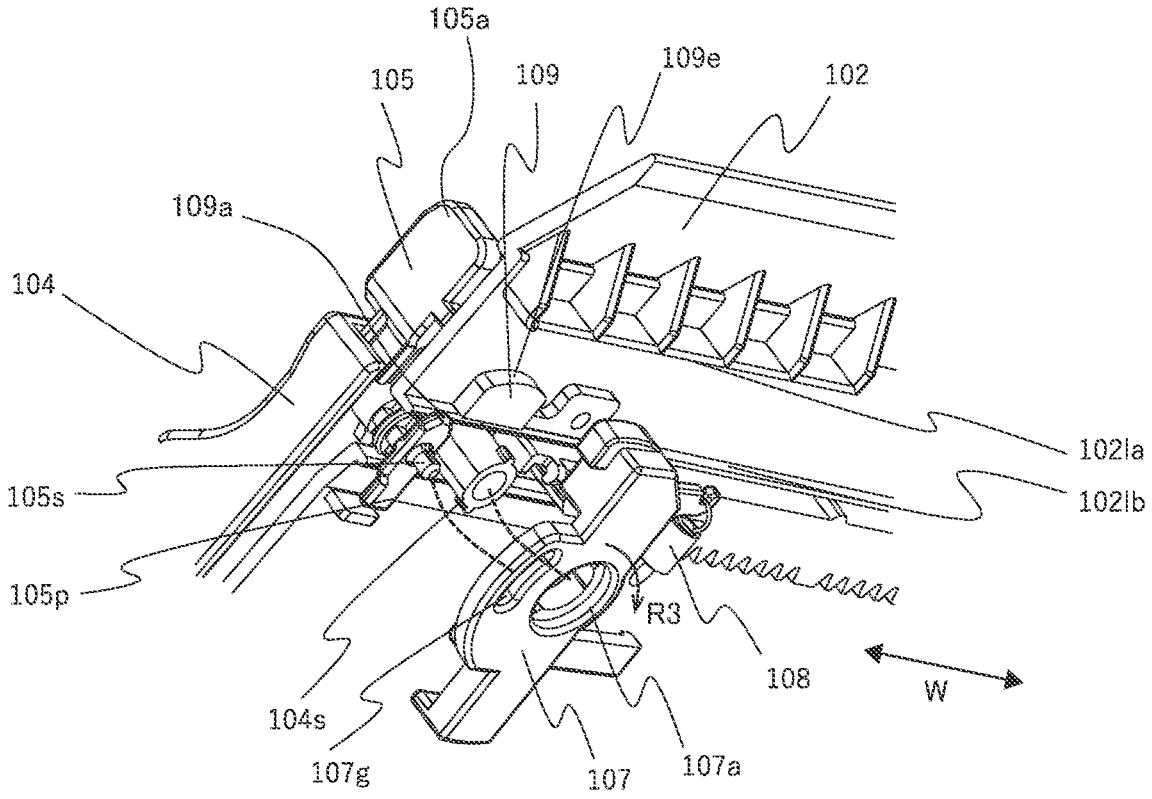
FIG. 15 is an exploded perspective view illustrating the brake mechanism.
Figure 16:
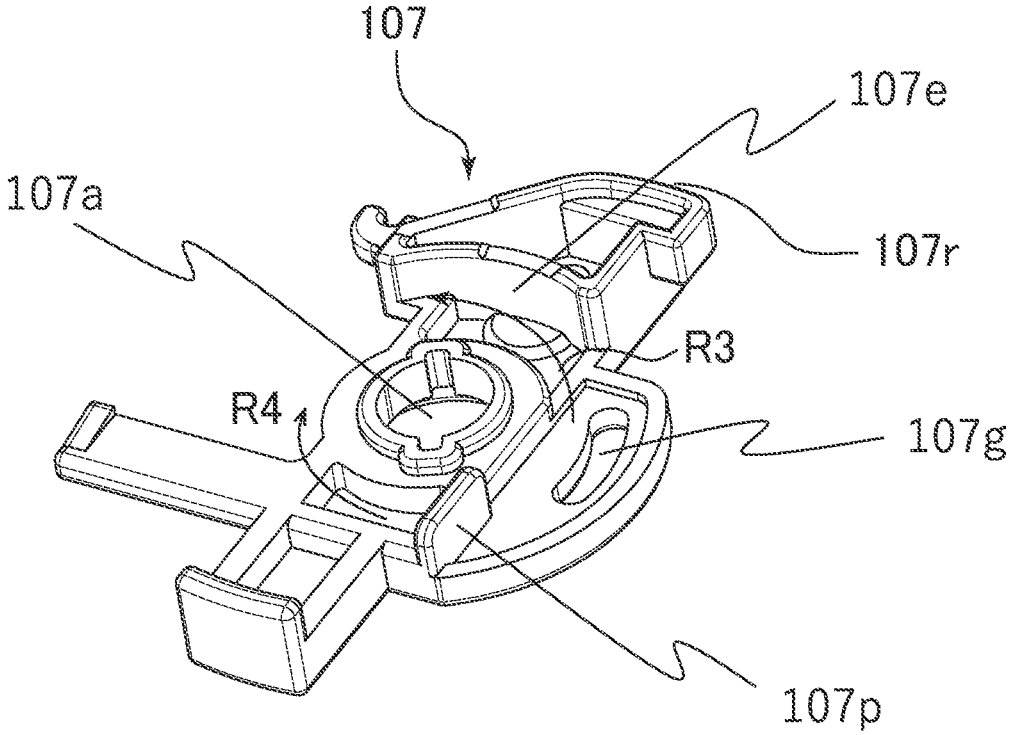
FIG. 16 is a perspective view illustrating a brake member.

Next, a configuration of the brake mechanism 106 will be described with reference to FIGS. 14 to 16. As illustrated in FIGS. 14 to 16, the brake mechanism 106 includes a brake member 107, a spring 108, a brake wall 102*la*, a rail wall 102*lb*, a brake piece 109, and a brake release lever 105.

The side regulation plate 104 includes a shaft portion 104*s* that engages with a hole portion 107*a* of the brake member 107. Thus, the brake member 107 is supported so as to be able to pivot on the shaft portion 104*s* of the side regulation plate 104. The brake wall 102*la* and the rail wall 102*lb* are disposed on the manual feed tray 102, and extend in the width direction W. Note that the brake wall 102*la* and the rail wall 102*lb* are disposed, shifted from each other in the sheet conveyance direction.

The brake member 107 includes a brake surface 107*r* that can abut against the brake wall 102*la*, a circumferential surface 107*e* that is formed around the hole portion 107*a*, a long hole 107*g* that is formed around the hole portion 107*a* and extending like an arc, and a release surface 107*p*. The brake member 107 is urged by an urging force of the spring 108, which serves as a brake urging portion, toward a direction indicated by an arrow R3 around the shaft portion 104*s*; and the brake surface 107*r* is pressed against the brake wall 102*la*.

As illustrated in FIG. 15, the brake piece 109 is sandwiched between the manual feed tray 102 and the brake member 107 in the thickness direction of the brake piece 109. The brake piece 109 includes a circumferential surface 109*e* that engages with the circumferential surface 107*e* of the brake member 107, and a slide surface 109*a* that can slide on the rail wall 102*lb*.

The spring 108 produces the contact force applied between the brake surface 107*r* and the brake wall 102*la*, and the reaction force of the contact force produces the nipping force that causes the circumferential surface 107*e* of the brake member 107 and the rail wall 102*lb* to nip the brake piece 109. In other words, the brake member 107 and the brake piece 109 are nipped between the brake wall 102*la* and the rail wall 102*lb*.

The brake member 107, the spring 108, the brake piece 109, and the brake release lever 105 are arranged so as to move together with the side regulation plate 104, in the width direction W. However, if the brake piece 109 is nipped by the circumferential surface 107*e* of the brake member 107 and the rail wall 102*lb*, the brake piece 109 applies brake force so that the side regulation plate 104 does not move in the width direction W.

Note that since the brake wall 102*la* and the rail wall 102*lb* extend in the width direction W, the brake mechanism 106 can apply the brake force to the side regulation plate 104, regardless of the position of the side regulation plate 104 in the width direction W.

As illustrated in FIGS. 14 to 16, the brake release lever 105, which serves as a brake release member, is pivotally supported by the side regulation plate 104. The brake release lever 105 includes a shaft 105*s*, a holding portion 105*a*, and a release portion 105*p*. The shaft 105*s* is disposed on the pivot axis of the brake release lever 105, and loosely fits in the long hole 107*g* of the brake member 107.

For releasing the brake of the side regulation plate 104, a user pivots the brake release lever 105 on the shaft 105*s*, toward a direction indicated by an arrow R1 (see FIG. 12), by operating the holding portion 105*a*. As a result, the release portion 105*p* abuts against the release surface 107*p* of the brake member 107. If the brake release lever 105 is further pivoted, in this state, toward the direction indicated by the arrow R1, the brake member 107 pivots on the shaft portion 104*s*, toward a below-described brake release position (see FIG. 17B). When the brake release lever 105 is positioned at the brake release position, the brake of the side regulation plate 104 applied by the brake mechanism 106 is released.

Operation of Brake Mechanism

Next, an operation of the brake mechanism 106 will be described more specifically with reference to FIGS. 17A to 17C. As described above, the brake mechanism 106 of the present embodiment can release the brake force applied to the side regulation plate 104, by a user operating the brake release lever 105. In addition, in a state where the brake release lever 105 is not operated by a user, the operation of the brake mechanism 106 performed when the external force is applied to the side regulation plate 104 in the first direction WD1 is different from the operation of the brake mechanism 106 performed when the external force is applied to the side regulation plate 104 in the second direction WD2. Hereinafter, the operation of the brake mechanism 106 performed when the external force is applied to the side regulation plate 104 in the first direction WD1, and the operation of the brake mechanism 106 performed when the external force is applied to the side regulation plate 104 in the second direction WD2 will be described sequentially.

First, with reference to FIG. 17A, the operation of the brake mechanism 106 performed when the external force is applied to the side regulation plate 104 in the first direction WD1, in a state where the brake release lever 105 is not operated by a user, will be described. As one example, the case where the external force is applied to the side regulation plate 104 in the first direction WD1 is a case where the regulation surface 104*a* of the side regulation plate 104 receives force from the sheet S when the sheet S stacked on the manual feed tray 102 is fed by the pickup roller 16. As another example, the case where the external force is applied to the side regulation plate 104 in the first direction WD1 is a case where a user tries to manually move the side regulation plate 104 in the first direction WD1.

Figure 17A:
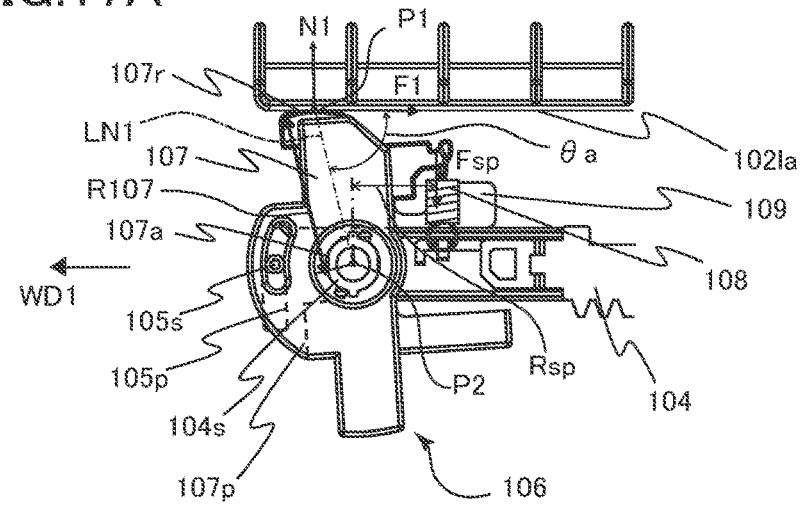
FIG. 17A is a diagram illustrating an operation of the brake mechanism performed when a side regulation plate is moved toward a first direction.
Figure 17B:
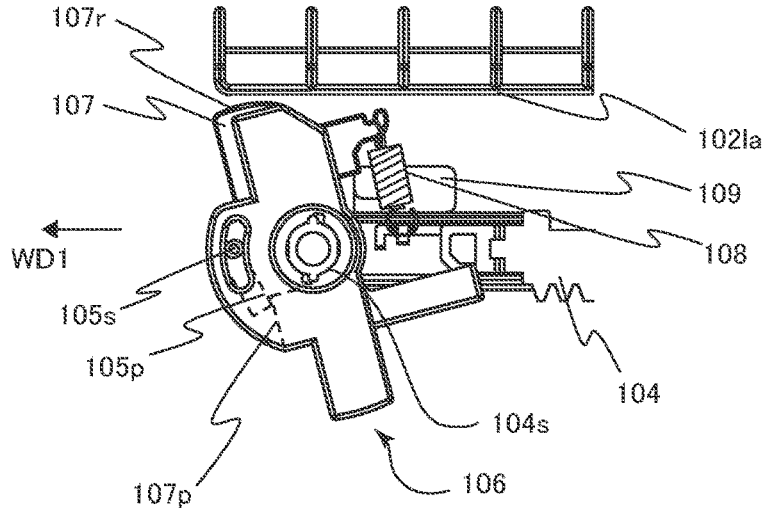
FIG. 17B is a diagram illustrating an operation of the brake mechanism that is in a state where a brake release lever is being operated.

As illustrated in FIG. 17A, if the external force tries to move the side regulation plate 104 toward the first direction WD1, a frictional force F1 that serves as a second frictional force is produced. The frictional force F1 is brake force produced between the brake surface 107*r* of the brake member 107 and the brake wall 102*la*. When the frictional force F1 is produced, the brake surface 107*r* exerts a normal force N1 on the brake wall 102*la*. The frictional force F1 and the normal force N1 are expressed by the following computational equation.

$$F1=\mu\times N1 \quad (1)$$

$$N1=F1\times\tan\theta a+(Fsp\times Rsp)/(R107\times\cos\theta a) \quad (2)$$

μ: a coefficient of friction between the brake surface 107*r* and the brake wall 102*la*

θa: an angle between a straight line LN1 and the brake wall 102*la*, where the straight line LN1 passes through a contact point P1 between the brake surface 107*r* and the brake wall 102*la* and a center P2 of the shaft portion 104*s*

R107: a distance between the contact point P1 and the center P2

Fsp: a force produced by the spring 108

Rsp: a radius in the rotation moment that the spring 108 gives the brake member 107

From the above-described equations (1) and (2), the frictional force F1 that is the brake force is expressed by the following equation (3).

$$F1=[\mu\times(Fsp\times Rsp)/(R107\times\cos\theta a)]/(1-\mu\times\tan\theta a) \quad (3)$$

From equation (3), it is understood that even when the coefficient of friction and the force Fsp produced by the spring 108 have small values, the frictional force F1 has a relatively large value if the angle θa has a value near 90 degrees. For example, if is 0.3, R107 is 20 mm, Fsp is 150 gf, Rsp is 20 mm, and θa is 70 degrees, the frictional force F1 is 748.5 gf. Thus, even if the external force is applied to the side regulation plate 104 in the first direction WD1, the frictional force F1 can sufficiently hold the side regulation plate 104 so that the side regulation plate 104 does not move.

As is clear from the above-described equations (1) and (2), the frictional force F1 includes a force, F1×tan θa, which is applied as the brake surface 107*r* bites into the brake wall 102*la*. For example, if a user tries to move the side regulation plate 104 toward the first direction WD1 while the contact point P1 hardly moves due to the frictional force F1, the angle θa increases. Note that the angle θa is larger than 0 degrees and smaller than 90 degrees. If a user tries to move the side regulation plate 104 toward the first direction WD1, the force, F1×tan θa, increases, increasing the frictional force F1. In other words, the frictional force F1 increases as the side regulation plate 104 moves more downstream in the first direction WD1 in a state where the brake surface 107*r* is in contact with the brake wall 102*la*.

Thus, even if the sheet S presses the regulation surface 104*a* of the side regulation plate 104 for example, the position of the side regulation plate 104 is kept by the brake mechanism 106, so that the failure in conveyance of sheets, such as skew of sheets, can be reduced.

Next, with reference to FIG. 17B, the operation of the brake mechanism 106 performed when a user tries to move the side regulation plate 104 toward the first direction WD1 while pivoting the brake release lever 105 toward the direction indicated by the arrow R1 will be described. If a user operates and pivots the brake release lever 105 toward the direction indicated by the arrow R1 (see FIG. 12), the brake member 107 pivots and moves to the brake release position, as illustrated in FIG. 17B.

As a result, the brake surface 107*r* of the brake member 107 is separated from the brake wall 102*la* of the manual feed tray 102, and the above-described frictional force F1 disappears. Thus, the user can move the side regulation plate 104 toward the first direction WD1, with weak force in a state where the frictional force F1 is not produced. In addition, even when the user tries to move the side regulation plate 104 toward the second direction WD2 while pivoting the brake release lever 105 toward the direction indicated by the arrow R1, the frictional force F1 is not produced.

Next, with reference to FIG. 17C, the operation of the brake mechanism 106 performed when the external force is applied to the side regulation plate 104 in the second direction WD2, in a state where the brake release lever 105 is not operated by a user, will be described. For example, the case where the external force is applied to the side regulation plate 104 in the second direction WD2 is a case where a user tries to manually move the side regulation plate 104 toward the second direction WD2.

Figure 17C:
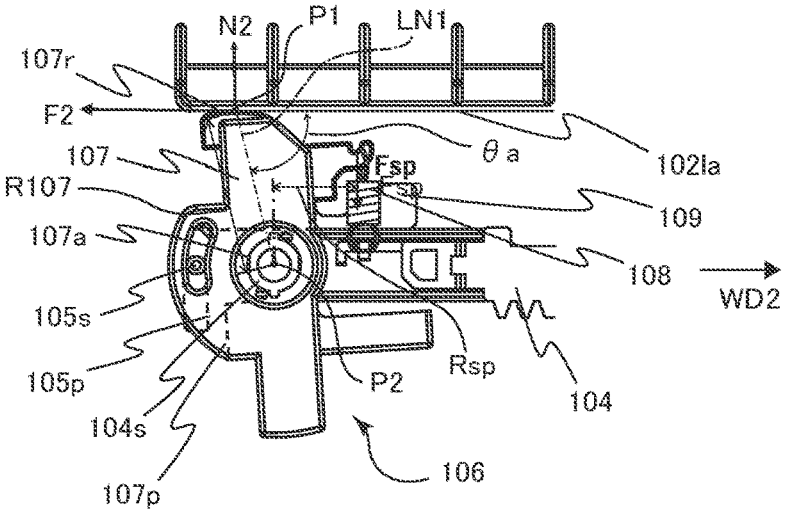
FIG. 17C is a diagram illustrating an operation of the brake mechanism performed when the side regulation plate is moved toward a second direction.

As illustrated in FIG. 17C, if the external force tries to move the side regulation plate 104 toward the second direction WD2, a frictional force F2 that serves as a first frictional force is produced. The frictional force F2 is brake force produced between the brake surface 107*r* and the brake wall 102*la*. When the frictional force F2 is produced, the brake surface 107*r* exerts a normal force N2 on the brake wall 102*la*. The frictional force F2 and the normal force N2 are expressed by the following computational equation.

$$F2=\mu\times N2 \quad (4)$$

$$N2=(Fsp\times Rsp)/(R107\times\cos\theta a) \quad (5)$$

From the above-described equations (4) and (5), the frictional force F2 that is the brake force is expressed by the following equation (6).

$$F2=\mu\times(Fsp\times Rsp)/(R107\times\cos\theta a) \quad (6)$$

If a user tries to move the side regulation plate 104 toward the second direction WD2, the brake surface 107*r* behaves so as to separate from the brake wall 102*la*, due to the frictional force F2. Thus, as is clear from the above-described equation (6) and is different from the description made with reference to FIG. 17A, the frictional force F2 does not include the force, F1×tan θa, which is applied as the brake surface 107*r* bites into the brake wall 102*la*.

Similar to the parameters described with reference to FIG. 17A, if is 0.3, R107 is 20 mm, Fsp is 150 gf, Rsp is 20 mm, and θa is 70 degrees, the frictional force F2 is 131.5 gf. That is, the above-described frictional force F1 is larger than the frictional force F2. In addition, since the frictional force F2 does not include the above-described force, F1×tan θa, the brake surface 107*r* slides on the brake wall 102*la* and the angle θa is unchanged even if the side regulation plate 104 is moved toward the second direction WD2. In other words, even if the side regulation plate 104 is moved downstream in the second direction WD2 in a state where the brake surface 107*r* is in contact with the brake wall 102*la*, the frictional force F2 is constant.

Thus, a user can move the side regulation plate 104 toward the second direction WD2 against the frictional force F2 with relatively weak force, without moving the brake release lever 105 toward the direction indicated by the arrow R1. That is, a user can easily move the side regulation plates 103 and 104 toward a direction in which the side regulation plates 103 and 104 move closer to the sheet S stacked on the manual feed tray 102. In this manner, a user can easily regulate the position of the sheet Sin the width direction W. Thus, the usability can be improved.

In addition, the brake mechanism 106 of the present embodiment can steplessly regulate the position of the side regulation plate 104 in the width direction W. Thus, the distance between an edge portion of the sheet S in the width direction W and the regulation surface 103*a* of the side regulation plate 103, and the distance between an edge portion of the sheet S in the width direction and the regulation surface 104*a* of the side regulation plate 104 can be made smaller, so that the sheet S can be positioned with high accuracy. For example, there is a case in which the size of the sheet S differs from the nominal size of the sheet S due to a tolerance produced in the cutting process of the sheet S. Even in such a case, since the distance between an edge portion of the sheet S in the width direction W and the regulation surface 103*a*, and the distance between an edge portion of the sheet S in the width direction and the regulation surface 104*a* can be minimized, the failure in conveyance of sheets, such as skew of sheets, can be reduced.

Other Embodiments

In the present embodiment, the first shaft portion 70*a* and the second shaft portion 70*b* are disposed in the handle 70, and the first hole portion 50*a* and the second hole portion 50*b* are disposed in the conveyance cover 50. However, the present disclosure is not limited to this. For example, the first hole portion and the second hole portion may be disposed in the handle 70, and the first shaft portion and the second shaft portion, which engage with the first hole portion and the second hole portion, may be disposed in the conveyance cover 50.

In addition, although the description has been made for the image forming apparatus 1 in the present embodiment, the present invention is not limited to this. For example, the present invention may be applied to a large-capacity feeding deck that can be connected to the image forming apparatus 1, or to another sheet conveyance apparatus, such as a post-process apparatus, that does not include the image forming portion 20.

In addition, although the locking member 53 is disposed, in the present embodiment, so as to be able to slide in the vertical direction VD, the present disclosure is not limited to this. For example, the locking member 53 may be pivotally supported by the conveyance guide 52 or another member.

In addition, although the brake mechanism 106 is disposed in the side regulation plate 104 in the present embodiment, the present disclosure is not limited to this. For example, the brake mechanism 106 may be disposed in the side regulation plate 103 or a trailing-edge regulation plate that regulates the position of the trailing edge of the sheet.

In addition, although the brake mechanism 106 produces a predetermined frictional force, in the present embodiment, when the brake mechanism 106 moves toward the second direction WD2 in a state where the brake release lever 105 is not operated, the present disclosure is not limited to this. That is, the brake mechanism 106 may produce no frictional force when the brake mechanism 106 moves toward the second direction WD2, even in a state where the brake release lever 105 is not operated.

In addition, although the brake mechanism 106 is disposed, in the present embodiment, in the side regulation plate 104 of the manual-feed conveyance portion 2, the present disclosure is not limited to this. For example, the brake mechanism 106 may be disposed in a side regulation plate disposed in the cassette 11, or may be disposed in a side regulation plate disposed in an auto document feeder (ADF).

In addition, although the description has been made for the electrophotographic image forming apparatus 1 in the present embodiment, the present invention is not limited to this. For example, the present invention may also be applied to an ink-jet image forming apparatus that forms images on sheets by injecting ink from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-091005, filed Jun. 3, 2022, which is hereby incorporated by reference herein in its entirety.

What is claimed is:

1. A sheet conveyance apparatus comprising:

an apparatus body including a conveyance assembly configured to convey a sheet; and a door pivotally supported around a pivot axis disposed in a lower portion of the apparatus body such that the door is opened and closed with respect to the apparatus body, wherein the apparatus body includes a handle assembly including a first holder used to lift the apparatus body and is disposed inside a width of the door in an axis direction of the pivot axis, wherein the handle assembly includes a first engaging section and a second engaging section disposed on the pivot axis, wherein the door includes:

a first engaged section configured to engage with the first engaging section; and a second engaged section configured to engage with the second engaging section, and wherein the door is pivotably supported around the first engaging section and the second engaging section with respect to the handle assembly.

2. The sheet conveyance apparatus according to claim 1, wherein the first holder is disposed between the first engaging section and the second engaging section in the axis direction.

3. The sheet conveyance apparatus according to claim 1, wherein the first engaging section is disposed on a first end surface of the handle assembly in the axis direction, and wherein the second engaging section is disposed on a second end surface of the handle assembly in the axis direction.

4. The sheet conveyance apparatus according to claim 3, wherein the first engaging section is disposed on a lower edge portion of the first end surface, and wherein the second engaging section is disposed on a lower edge portion of the second end surface.

5. The sheet conveyance apparatus according to claim 1, wherein the first engaging section and the second engaging section are shaft portions extending in directions that extend away from each other in the axis direction, and wherein the first engaged section and the second engaged section are hole portions configured to respectively engage with the first engaging section and the second engaging section.

6. The sheet conveyance apparatus according to claim 1, wherein a distance between the first engaging section and the second engaging section in the axis direction is equal to or larger than two thirds of a width of the door in the axis direction.

7. The sheet conveyance apparatus according to claim 1, wherein the door includes a conveyance guide configured to constitute a part of a conveyance path through which a sheet conveyed by the conveyance assembly passes, and wherein a distance between the first engaging section and the second engaging section in the axis direction is larger than a length of the conveyance assembly in the axis direction.

8. The sheet conveyance apparatus according to claim 1, wherein the first holder is recessed with respect to an exterior surface of the door in a state where the door is closed with respect to the apparatus body.

9. The sheet conveyance apparatus according to claim 1, wherein the apparatus body includes a lockable assembly, wherein the door includes:

a second holder configured to be held by a user;

a conveyance assembly configured to constitute a part of a conveyance path through which a sheet conveyed by the conveyance assembly passes;

a cover movably supported by the door between a first position and a second position, the first position being a position at which the cover covers the second holder and is flush with an exterior surface of the door, the second position being a position that allows the user to access the second holder;

a lock configured to move with respect to the conveyance assembly between a locking position and an unlocking position, the locking position being a position at which the lock engages with the lockable assembly so as to lock the door on the apparatus body, the unlocking position being a position at which the lock is separated from the lockable assembly so as to allow the door to be opened and closed with respect to the apparatus body; and a biasing element configured to urge the door toward a direction in which the door is opened with respect to the apparatus body, wherein the lock moves from the locking position to the unlocking position in accordance with a movement of the cover from the first position toward the second position, and wherein the door is opened with respect to the apparatus body by an urging force of the biasing element in a case where the lock moves from the locking position to the unlocking position.

10. The sheet conveyance apparatus according to claim 9, wherein the lock moves from the locking position to the unlocking position by being pressed by the cover in a case where the cover moves from the first position toward the second position.

11. The sheet conveyance apparatus according to claim 9, wherein the lock is supported such that the lock is configured to slide with respect to the conveyance assembly between the locking position and the unlocking position.

12. The sheet conveyance apparatus according to claim 9, wherein the apparatus body includes a first roller, wherein the sheet conveyance apparatus further includes a second roller that is configured to be rotatably supported by the door, and that is in contact with the first roller in a state where the door is closed with respect to the apparatus body, and wherein the biasing element is configured to urge the second roller toward the first roller in a state where the door is closed with respect to the apparatus body.

13. An image forming apparatus comprising:

the sheet conveyance apparatus according to claim 1; and an image forming portion disposed in the apparatus body and configured to form an image on a sheet conveyed by the sheet conveyance apparatus.

* * * * *